US010681487B2

(12) United States Patent
Nakano

(10) Patent No.: US 10,681,487 B2
(45) Date of Patent: Jun. 9, 2020

(54) ACOUSTIC SIGNAL PROCESSING APPARATUS, ACOUSTIC SIGNAL PROCESSING METHOD AND PROGRAM

(71) Applicant: Sony Corporation, Tokyo (JP)

(72) Inventor: Kenji Nakano, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 16/323,893

(22) PCT Filed: Aug. 2, 2017

(86) PCT No.: PCT/JP2017/028105
§ 371 (c)(1),
(2) Date: Feb. 7, 2019

(87) PCT Pub. No.: WO2018/034158
PCT Pub. Date: Feb. 22, 2018

(65) Prior Publication Data

US 2019/0174248 A1 Jun. 6, 2019

(30) Foreign Application Priority Data

Aug. 16, 2016 (JP) ..... 2016-159545

(51) Int. Cl.
*H04S 7/00* (2006.01)
*H04S 3/00* (2006.01)
(Continued)

(52) U.S. Cl.
CPC ..... *H04S 7/303* (2013.01); *H04R 3/04* (2013.01); *H04R 3/12* (2013.01); *H04R 5/04* (2013.01);
(Continued)

(58) Field of Classification Search
CPC . H04S 7/303; H04S 7/30; H04S 3/002; H04S 2400/01; H04S 2420/01; H04R 5/04; H04R 3/12; H04R 3/04
See application file for complete search history.

(56) References Cited

U.S. PATENT DOCUMENTS 4,975,954 A * 12/1990 Cooper ..... H04S 1/002 381/1
6,285,766 B1 * 9/2001 Kumamoto ..... H04S 1/007 381/123
(Continued)

FOREIGN PATENT DOCUMENTS

GB 2342830 A * 4/2000 ..... H04R 5/02
JP 10-136497 A 5/1998
(Continued)

OTHER PUBLICATIONS

International Search Report and Written Opinion and English translations thereof dated Sep. 26, 2017 in connection with International Application No. PCT/JP2017/028105.
(Continued)

*Primary Examiner* — Oyesola C Ojo
(74) *Attorney, Agent, or Firm* — Wolf, Greenfield & Sacks, P.C.

(57) ABSTRACT

The present technology relates to an acoustic signal processing apparatus, an acoustic signal processing method and a program which can widen the variations of the configuration of a virtual surround system that stabilizes the localization sensation of a virtual speaker.
Crosstalk correction processing is performed on a first binaural signal based on a sound source opposite side HRTF and a second binaural signal based on a sound source side HRTF. A first acoustic signal and a second acoustic signal are generated. A component of a first frequency band, in which a first notch of the sound source opposite side HRTF
(Continued)

appears, and a component of a second frequency band, in which a second notch appears, are attenuated in an input signal or the second binaural signal, thereby attenuating the component of the first frequency band and the component of the second frequency band of the first acoustic signal and the second acoustic signal. An auxiliary signal including a component of a third frequency band of the input signal or the second binaural signal, in which the component of the first frequency band and the component of the second frequency band are attenuated, is added to the first acoustic signal, and a third acoustic signal is generated. The present technology can be applied to, for example, an AV amplifier.

12 Claims, 11 Drawing Sheets

(51) Int. Cl.
*H04R 3/04* (2006.01)
*H04R 3/12* (2006.01)
*H04R 5/04* (2006.01)

(52) U.S. Cl.
CPC ..... *H04S 3/002* (2013.01); *H04S 7/30* (2013.01); *H04S 2400/01* (2013.01); *H04S 2420/01* (2013.01)

(56) References Cited

U.S. PATENT DOCUMENTS 6,418,226 B2 * 7/2002 Mukojima ..... H04S 1/002 381/17
6,442,277 B1 * 8/2002 Lueck ..... H04S 5/00 381/1
6,643,375 B1 * 11/2003 Philp ..... H04S 1/005 381/1
7,945,054 B2 * 5/2011 Kim ..... H04S 1/00 381/1
8,270,642 B2 * 9/2012 Kuhn ..... H04S 7/30 381/17
9,107,021 B2 * 8/2015 Florencio ..... H04S 7/302
9,253,573 B2 * 2/2016 Nakano ..... H04R 5/02
9,961,468 B2 * 5/2018 Takeuchi ..... H04S 5/00
2001/0040968 A1 11/2001 Mukojima
2005/0135643 A1 * 6/2005 Lee ..... H04S 3/008 381/309
2008/0031462 A1 * 2/2008 Walsh ..... H04S 3/02 381/17
2008/0063224 A1 * 3/2008 De Klerk ..... H04R 1/227 381/304
2008/0187143 A1 * 8/2008 Mak-Fan ..... H04M 3/56 381/17
2010/0266133 A1 * 10/2010 Nakano ..... H04R 3/04 381/17
2011/0286601 A1 * 11/2011 Fukui ..... H04S 7/30 381/17
2011/0286614 A1 * 11/2011 Hess ..... H04S 7/303 381/302
2014/0286511 A1 9/2014 Nakano

FOREIGN PATENT DOCUMENTS

JP 10136497 A * 5/1998 ..... H04S 5/00
JP 10-174200 A 6/1998
JP 2013-110682 A 6/2013
JP 2015-211418 A 11/2015

OTHER PUBLICATIONS

International Preliminary Report on Patentability and English translation thereof dated Feb. 28, 2019 in connection with International Application No. PCT/JP2017/028105.

* cited by examiner

ACOUSTIC SIGNAL PROCESSING APPARATUS, ACOUSTIC SIGNAL PROCESSING METHOD AND PROGRAM

CROSS REFERENCE TO RELATED APPLICATIONS

This is a U.S. National Stage Application under 35 U.S.C. § 371, based on International Application No. PCT/JP2017/028105, filed Aug. 2, 2017, which claims priority to Japanese Patent Application JP 2016-159545, filed Aug. 16, 2016, each of which is hereby incorporated by reference in its entirety.

TECHNICAL FIELD

The present technology relates to an acoustic signal processing apparatus, an acoustic signal processing method and a program, and more particularly relates to an acoustic signal processing apparatus, an acoustic signal processing method and a program which widen the variations of the configuration of a virtual surround system that stabilizes the localization sensation of a virtual speaker.

BACKGROUND ART

Conventionally, a virtual surround system, which improves the localization sensation of a sound image at a position deviated to the left or the right from the median plane of a listener, has been proposed (e.g., see Patent Document 1).

Further, conventionally, a technology, which stabilizes the localization sensation of a virtual speaker even in a case where the volume of one speaker is significantly smaller than the volume of the other speaker in a virtual surround system that improves the localization sensation of a sound image at a position deviated to the left or the right from the median plane of a listener, has been proposed (e.g., see Patent Document 2).

CITATION LIST

Patent Document

Patent Document 1: Japanese Patent Application Laid-Open No. 2013-110682

Patent Document 2: Japanese Patent Application Laid-Open No. 2015-211418

SUMMARY OF THE INVENTION

Problems to be Solved by the Invention

Incidentally, in the technology described in Patent Document 2, it is desired to widen the variations of the configuration in order to facilitate circuit design and the like.

Thereupon, the present technology is intended to widen the variations of the configuration of the virtual surround system that stabilizes the localization sensation of the virtual speaker.

Solutions to Problems

An acoustic signal processing apparatus according to one aspect of the present technology includes: a first transaural processing unit that generates a first binaural signal for a first input signal, which is an acoustic signal for a first virtual sound source deviated to left or right from a median plane of a predetermined listening position, by using a first head-related transfer function between an ear of a listener at the listening position farther from the first virtual sound source and the first virtual sound source, generates a second binaural signal for the first input signal by using a second head-related transfer function between an ear of the listener closer to the first virtual sound source and the first virtual sound source, and generates a first acoustic signal and a second acoustic signal by performing crosstalk correction processing on the first binaural signal and the second binaural signal as well as attenuates a component of a first frequency band and a component of a second frequency band in the first input signal or the second binaural signal to attenuate the component of the first frequency band and the component of the second frequency band of the first acoustic signal and the second acoustic signal, the first frequency band being lowest and the second frequency band being second lowest at a predetermined first frequency or more of frequency bands in which notches, which are negative peaks with amplitude of a predetermined depth or deeper, appear in the first head-related transfer function; and a first auxiliary signal synthesizing unit that generates a third acoustic signal by adding a first auxiliary signal to the first acoustic signal, the first auxiliary signal including a component of a predetermined third frequency band of the first input signal, in which the component of the first frequency band and the component of the second frequency band are attenuated, or the component of the third frequency band of the second binaural signal, in which the component of the first frequency band and the component of the second frequency band are attenuated.

The first transaural processing unit can be provided with: an attenuating unit that generates an attenuation signal obtained by attenuating the component of the first frequency band and the component of the second frequency band of the first input signal; and a signal processing unit that integrally performs processing for generating the first binaural signal obtained by superimposing the first head-related transfer function on the attenuation signal and the second binaural signal obtained by superimposing the second head-related transfer function on the attenuation signal and the crosstalk correction processing on the first binaural signal and the second binaural signal, and the first auxiliary signal can include the component of the third frequency band of the attenuation signal.

The first transaural processing unit can be provided with: a first binauralization processing unit that generates the first binaural signal obtained by superimposing the first head-related transfer function on the first input signal; a second binauralization processing unit that generates the second binaural signal obtained by superimposing the second head-related transfer function on the first input signal as well as attenuates the component of the first frequency band and the component of the second frequency band of the first input signal before the second head-related transfer function is superimposed or of the second binaural signal after the second head-related transfer function is superimposed; and a crosstalk correction processing unit that performs the crosstalk correction processing on the first binaural signal and the second binaural signal.

The first binauralization processing unit can be caused to attenuate the component of the first frequency band and the component of the second frequency band of the first input signal before the first head-related transfer function is superimposed or of the first binaural signal after the first head-related transfer function is superimposed.

The third frequency band can be caused to include at least a lowest frequency band and a second lowest frequency band at a predetermined second frequency or more of frequency bands in which the notches appear in a third head-related transfer function between one speaker of two speakers arranged left and right with respect to the listening position and one ear of the listener, a lowest frequency band and a second lowest frequency band at a predetermined third frequency or more of frequency bands in which the notches appear in a fourth head-related transfer function between an other speaker of the two speakers and an other ear of the listener, a lowest frequency band and a second lowest frequency band at a predetermined fourth frequency or more of frequency bands in which the notches appear in a fifth head-related transfer function between the one speaker and the other ear, or a lowest frequency band and a second lowest frequency band at a predetermined fifth frequency or more of frequency bands in which the notches appear in a sixth head-related transfer function between the other speaker and the one ear.

A first delaying unit that delays the first acoustic signal by a predetermined time before the first auxiliary signal is added, and a second delaying unit that delays the second acoustic signal by the predetermined time can be further provided.

The first auxiliary signal synthesizing unit can be caused to adjust the level of the first auxiliary signal before the first auxiliary signal is added to the first acoustic signal.

A second transaural processing unit that generates a third binaural signal for a second input signal, which is an acoustic signal for a second virtual sound source deviated to left or right from the median plane, by using a seventh head-related transfer function between an ear of the listener farther from the second virtual sound source and the second virtual sound source, generates a fourth binaural signal for the second input signal by using an eighth head-related transfer function between an ear of the listener closer to the second virtual sound source and the second virtual sound source, and generates a fourth acoustic signal and a fifth acoustic signal by performing the crosstalk correction processing on the third binaural signal and the fourth binaural signal as well as attenuates a component of a fourth frequency band and a component of a fifth frequency band in the second input signal or the fourth binaural signal to attenuate the component of the fourth frequency band and the component of the fifth frequency band of the fifth acoustic signal, the fourth frequency band being lowest and the fifth frequency band being second lowest at a predetermined sixth frequency or more of frequency bands, in which the notches appear in the seventh head-related transfer function; a second auxiliary signal synthesizing unit that generates a sixth acoustic signal by adding a second auxiliary signal to the fourth acoustic signal, the second auxiliary signal including the component of the third frequency band of the second input signal, in which the component of the fourth frequency band and the component of the fifth frequency band are attenuated, or the component of the third frequency band of the fourth binaural signal, in which the component of the fourth frequency band and the component of the fifth frequency band are attenuated; and an adding unit that adds the third acoustic signal and the fifth acoustic signal and adds the second acoustic signal and the sixth acoustic signal in a case where the first virtual sound source and the second virtual sound source are separated to left and right with reference to the median plane, and adds the third acoustic signal and the sixth acoustic signal and adds the second acoustic signal and the fifth acoustic signal in a case where the first virtual sound source and the second virtual sound source are on the same side with reference to the median plane can be further provided.

The first frequency can be a frequency at which a positive peak appears in the vicinity of 4 kHz of the first head-related transfer function.

The crosstalk correction processing can be processing that cancels, for the first binaural signal and the second binaural signal, an acoustic transfer characteristic between a speaker of two speakers arranged left and right with respect to the listening position on an opposite side of the first virtual sound source with reference to the median plane and the ear of the listener farther from the first virtual sound source, an acoustic transfer characteristic between a speaker of the two speakers on a side of the virtual sound source with reference to the median plane and the ear of the listener closer to the first virtual sound source, crosstalk from the speaker on the opposite side of the first virtual sound source to the ear of the listener closer to the first virtual sound source, and crosstalk from the speaker on the side of the virtual sound source to the ear of the listener farther from the first virtual sound source.

An acoustic signal processing method according to one aspect of the present technology includes: a transaural processing step that generates a first binaural signal for an input signal, which is an acoustic signal for a virtual sound source deviated to left or right from a median plane of a predetermined listening position, by using a first head-related transfer function between an ear of a listener at the listening position farther from the virtual sound source and the virtual sound source, generates a second binaural signal for the input signal by using a second head-related transfer function between an ear of the listener closer to the virtual sound source and the virtual sound source, and generates a first acoustic signal and a second acoustic signal by performing crosstalk correction processing on the first binaural signal and the second binaural signal as well as attenuates a component of a first frequency band and a component of a second frequency band in the input signal or the second binaural signal to attenuate the component of the first frequency band and the component of the second frequency band of the first acoustic signal and the second acoustic signal, the first frequency band being lowest and the second frequency band being second lowest at a predetermined frequency or more of frequency bands in which notches, which are negative peaks with amplitude of a predetermined depth or deeper, appear in the first head-related transfer function; and an auxiliary signal synthesizing step that generates a third acoustic signal by adding an auxiliary signal to the first acoustic signal, the auxiliary signal including a component of a predetermined third frequency band of the input signal, in which the component of the first frequency band and the component of the second frequency band are attenuated, or the component of the third frequency band of the second binaural signal, in which the component of the first frequency band and the component of the second frequency band are attenuated.

A program according to one aspect of the present technology causes a computer to execute processing including: a transaural processing step that generates a first binaural signal for an input signal, which is an acoustic signal for a virtual sound source deviated to left or right from a median plane of a predetermined listening position, by using a first head-related transfer function between an ear of a listener at the listening position farther from the virtual sound source and the virtual sound source, generates a second binaural signal for the input signal by using a second head-related transfer function between an ear of the listener closer to the virtual sound source and the virtual sound source, and generates a first acoustic signal and a second acoustic signal by performing crosstalk correction processing on the first binaural signal and the second binaural signal as well as attenuates a component of a first frequency band and a component of a second frequency band in the input signal or the second binaural signal to attenuate the component of the first frequency band and the component of the second frequency band of the first acoustic signal and the second acoustic signal, the first frequency band being lowest and the second frequency band being second lowest at a predetermined frequency or more of frequency bands in which notches, which are negative peaks with amplitude of a predetermined depth or deeper, appear in the first head-related transfer function; and an auxiliary signal synthesizing step that generates a third acoustic signal by adding an auxiliary signal to the first acoustic signal, the auxiliary signal including a component of a predetermined third frequency band of the input signal, in which the component of the first frequency band and the component of the second frequency band are attenuated, or the component of the third frequency band of the second binaural signal, in which the component of the first frequency band and the component of the second frequency band are attenuated.

In one aspect of the present technology, a first binaural signal is generated for an input signal, which is an acoustic signal for a virtual sound source deviated to left or right from a median plane of a predetermined listening position, by using a first head-related transfer function between an ear of a listener at the listening position farther from the virtual sound source and the virtual sound source, a second binaural signal is generated for the input signal by using a second head-related transfer function between an ear of the listener closer to the virtual sound source and the virtual sound source, and a first acoustic signal and a second acoustic signal are generated by performing crosstalk correction processing on the first binaural signal and the second binaural signal as well as a component of a first frequency band and a component of a second frequency band are attenuated in the input signal or the second binaural signal to attenuate the component of the first frequency band and the component of the second frequency band of the first acoustic signal and the second acoustic signal, the first frequency band being lowest and the second frequency band being second lowest at a predetermined frequency or more of frequency bands in which notches, which are negative peaks with amplitude of a predetermined depth or deeper, appear in the first head-related transfer function, and a third acoustic signal is generated by adding an auxiliary signal to the first acoustic signal, the auxiliary signal including a component of a predetermined third frequency band of the input signal, in which the component of the first frequency band and the component of the second frequency band are attenuated, or the component of the third frequency band of the second binaural signal, in which the component of the first frequency band and the component of the second frequency band are attenuated.

Effects of the Invention

According to one aspect of the present technology, it is possible to localize the sound image at a position deviated to the left or the right from the median plane of the listener in the virtual surround system. Moreover, according to one aspect of the present technology, it is possible to widen the variations of the configuration of the virtual surround system that stabilizes the localization sensation of the virtual speaker.

Note that the effects described herein are not necessarily limited and may be any one of the effects described in the present disclosure.

MODE FOR CARRYING OUT THE INVENTION

Hereinafter, modes for carrying out the present technology (hereinafter, referred to as embodiments) will be described. Note that the description will be given in the following order.

1. Explanation of Technology Underlying the Present Technology
2. First Embodiment (Example in Which Binauralization Processing and Crosstalk Correction Processing Are Performed Individually)
3. Second Embodiment (Example in Which Transaural Processing Is Integrated to Be Performed)
4. Third Embodiment (Example of Generating a Plurality of Virtual Speakers)
5. Modification Examples

1. Explanation of Technology Underlying the Present Technology

First, a technology underlying the present technology will be described with reference to FIGS. 1 and 2.

Conventionally, it has been known that peaks and dips, which appear on the higher frequency band side in the amplitude-frequency characteristics of a head-related transfer function (HRTF), are important clues to the localization sensation in the up-down and front-back directions of a sound image (e.g., see, Iida et al., "Spatial Acoustics," July 2010, pp. 19 to 21, Corona Publishing, Japan (hereinafter referred to as Non-Patent Document 1)). It is considered that these peaks and dips are formed by reflection, diffraction and resonance mainly caused by the shape of the ear.

Figure 1:
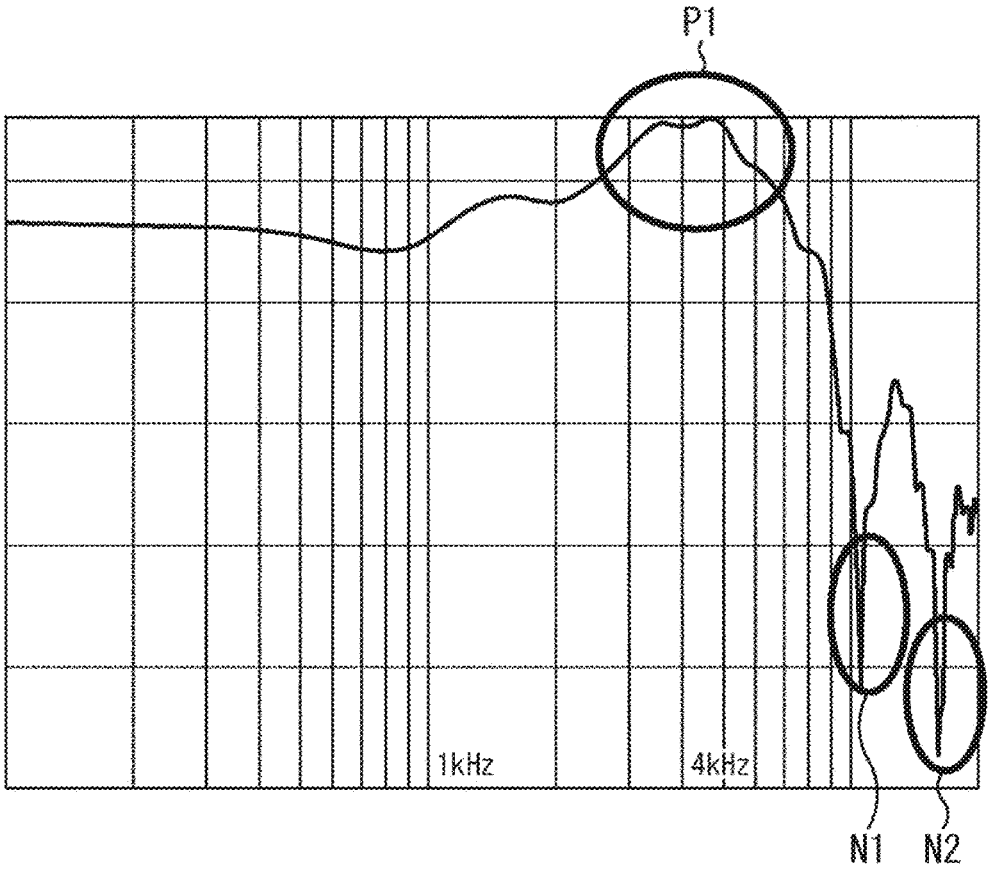
FIG. 1 is a graph showing one example of HRTF.

Moreover, Non-Patent Document 1 points out that, as shown in FIG. 1, a positive peak P1, which appears in the vicinity of 4 kHz, and two notches N1 and N2, which first appear in a frequency band greater than or equal to the frequency at which the peak P1 appears, highly contribute to the up-down and front-back localization sensation of the sound image in particular.

Here, in this specification, a dip refers to a portion recessed compared to the surroundings in a waveform diagram of the amplitude-frequency characteristics and the like of the HRTF. Also, a notch refers to a dip whose width (e.g., a frequency band in the amplitude-frequency characteristics of the HRTF) is particularly narrow and which has a predetermined depth or deeper, in other words, a steep negative peak which appears in the waveform diagram. Moreover, hereinafter, the notch N1 and the notch N2 in FIG. 1 are also referred to as a first notch and a second notch, respectively.

The peak P1 has no dependence on the direction of a sound source and appears in approximately the same frequency band regardless of the direction of the sound source. Then, it is considered in Non-Patent Document 1 that the peak P1 is a reference signal for the human auditory system to search for the first notch and the second notch, and the physical parameters which substantially contribute to the up-down and front-back localization sensation are the first notch and the second notch.

Furthermore, the above-described Patent Document 1 indicates that the first notch and the second notch which appear in the sound source opposite side HRTF are important for the up-down and front-back localization sensation of the sound image in a case where the position of the sound source is deviated to the left or the right from the median plane of the listener. It is also indicated that the amplitude of the sound in the frequency band where the first notch and the second notch appear at the ear on the sound source side does not significantly influence the up-down and front-back localization sensation of the sound image if the notches of the sound source opposite side HRTF can be reproduced at the ear of the listener on the sound source opposite side.

Here, the sound source side is closer to the sound source in the right-left direction with reference to the listening position, and the sound source opposite side is farther from the sound source. In other words, the sound source side is the same side as the sound source in a case where the space is divided into right and left with reference to the median plane of the listener at the listening position, and the sound source opposite side is the opposite side thereof. Further, the sound source side HRTF is the HRTF for the ear of listener on the sound source side, and the sound source opposite side HRTF is the HRTF for the ear of the listener on the sound source opposite side. Note that the ear of the listener on the sound source opposite side is also referred to as the ear on a shadow side.

In the technology described in Patent Document 1, using the above theory, notches of the same frequency bands as the first notch and the second notch, which appear in the sound source opposite side HRTF of the virtual speaker, are formed in an acoustic signal on the sound source side, and then transaural processing is performed. Accordingly, the first notch and the second notch are stably reproduced at the ear on the sound source opposite side, and the up-down and front-back position of the virtual speaker is stabilized.

Here, the transaural processing will be briefly described.

The technique of reproducing the sounds, which are recorded by microphones arranged at both ears, at both ears by headphones is known as a binaural recording/reproducing method. Two-channel signals recorded by the binaural recording are called binaural signals and include acoustic information associated with the position of the sound source not only in the right-left direction but also the up-down direction and the front-back direction for humans.

Moreover, the technique of reproducing these binaural signals by using speakers of right and left channels instead of headphones is called a transaural reproducing method. However, by merely outputting the sounds based on the binaural signals directly from the speakers, for example, crosstalk occurs in which the sound for the right ear is also audible to the left ear of the listener. Furthermore, for example, the acoustic transfer characteristics from the speaker to the right ear are superimposed during a period in which the sound for the right ear reaches the right ear of the listener, and the waveform is deformed.

Therefore, in the transaural reproducing method, pre-processing for canceling the crosstalk and extra acoustic transfer characteristics is performed on the binaural signals. Hereinafter, this pre-processing is referred to as crosstalk correction processing.

Incidentally, the binaural signals can be generated without recording with the microphones at the ears. Specifically, the binaural signals are obtained by superimposing the HRTFs from the position of the sound source to both ears on the acoustic signals. Therefore, if the HRTFs are known, the binaural signals can be generated by conducting signal processing for superimposing the HRTFs on the acoustic signals. Hereinafter, this processing is referred to as binauralization processing.

In a front surround system based on the HRTFs, the above binauralization processing and crosstalk correction processing are performed. Here, the front surround system is a virtual surround system which simulatively creates a surround sound field only by front speakers. Then, the combined processing of the binauralization processing and the crosstalk correction processing is the transaural processing.

However, in the technology described in Patent Document 1, the localization sensation of the sound image is reduced in a case where the volume of one speaker becomes significantly smaller than the volume of the other speaker. Here, the reasons thereof will be described with reference to FIG. 2.

Figure 2:
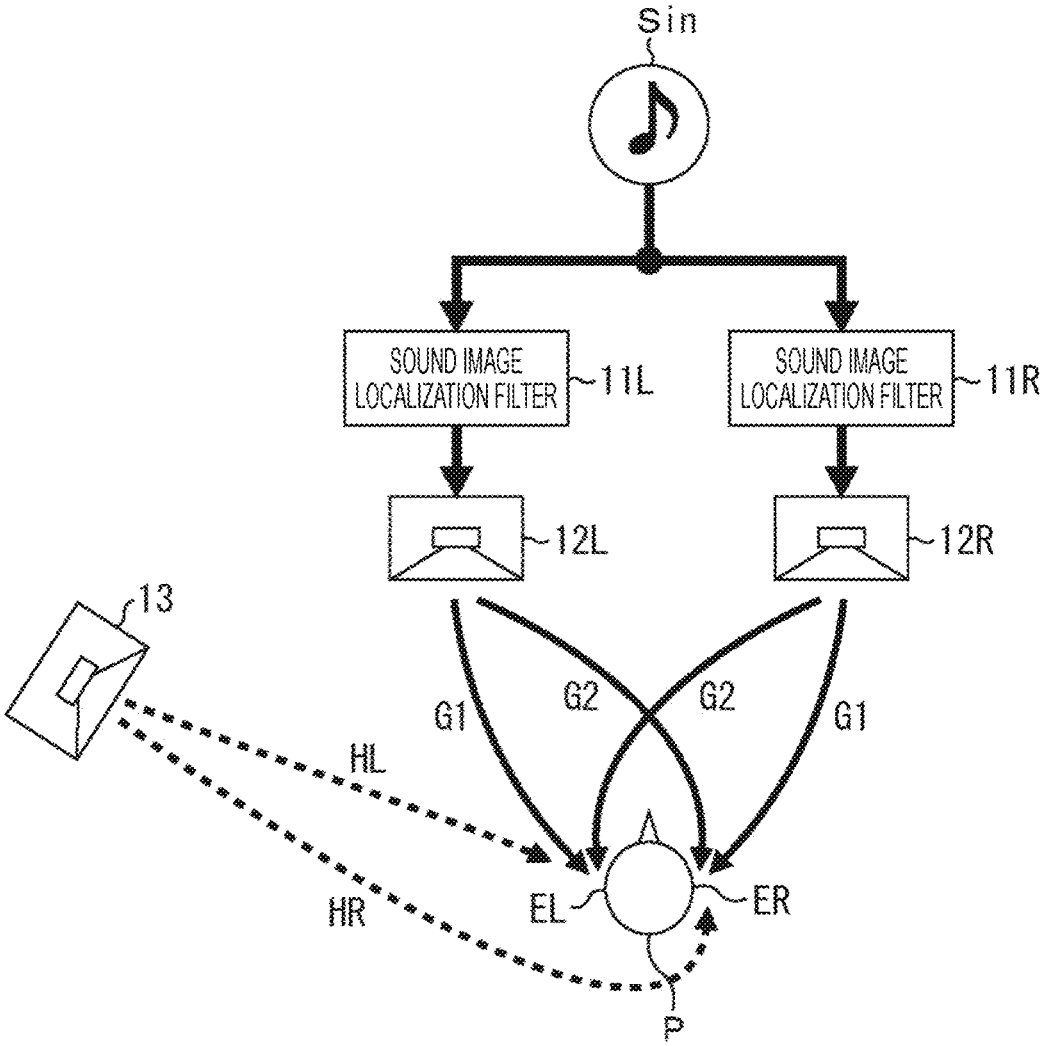
FIG. 2 is a diagram for explaining a technology underlying the present technology.

FIG. 2 shows an example of using sound image localization filters 11L and 11R to localize sound images, which are outputted from respective speakers 12L and 12R to a listener P at a predetermined listening position, at the position of a virtual speaker 13. Note that, hereinafter, a case where the position of the virtual speaker 13 is set obliquely upward to the front left of the listening position (listener P) will be described.

Note that, hereinafter, the sound source side HRTF between the virtual speaker 13 and a left ear EL of the listener P is referred to as a head-related transfer function HL, and the sound source opposite side HRTF between the virtual speaker 13 and a right ear ER of the listener P is referred to as a head-related transfer function HR. Moreover, hereinafter, for simplicity of explanation, the HRTF between the speaker 12L and the left ear EL of the listener P and the HRTF between the speaker 12R and the right ear ER of the listener P are regarded as the same, and the HRTFs are referred to as head-related transfer functions G1. Similarly, the HRTF between the speaker 12L and the right ear ER of the listener P and the HRTF between the speaker 12R and the left ear EL of the listener P are regarded as the same, and the HRTFs are referred to as head-related transfer functions G2.

As shown in FIG. 2, the head-related transfer function G1 is superimposed in a period in which the sound from the speaker 12L reaches the left ear EL of the listener P, and the head-related transfer function G2 is superimposed in a period in which the sound from the speaker 12R reaches the left ear EL of the listener P. Here, if the sound image localization filters 11L and 11R work ideally, the influences of the head-related transfer functions G1 and G2 are canceled, and the waveform of the sound obtained by synthesizing the sounds from both speakers at the left ear EL becomes a waveform obtained by superimposing the head-related transfer function HL on an acoustic signal Sin.

Similarly, the head-related transfer function G1 is superimposed in a period in which the sound from the speaker 12R reaches the right ear ER of the listener P, and the head-related transfer function G2 is superimposed in a period in which the sound from the speaker 12L reaches the right ear ER of the listener P. Here, if the sound image localization filters 11L and 11R work ideally, the influences of the head-related transfer functions G1 and G2 are canceled, and the waveform of the sound obtained by synthesizing the sounds from both speakers at the right ear ER becomes a waveform obtained by superimposing the head-related transfer function HR on the acoustic signal Sin.

Here, when the technology described in Patent Document 1 is applied to form, in the acoustic signal Sin inputted into the sound image localization filter 11L on the sound source side, the notches of the same frequency bands as the first notch and the second notch of the head-related transfer function HR on the sound source opposite side, the first notch and the second notch of the head-related transfer function HL as well as the notches of approximately the same frequency bands as the first notch and the second notch of the head-related transfer function HR appear at the left ear EL of the listener P. The first notch and the second notch of the head-related transfer function HR also appear at the right ear ER of the listener P. Accordingly, the first notch and the second notch of the head-related transfer function HR are stably reproduced at the right ear ER of the listener P on the shadow side, and the up-down and front-back position of the virtual speaker 13 is stabilized.

However, this is a case where the crosstalk correction processing is ideally performed, and it is difficult to completely cancel the crosstalk and extra acoustic transfer characteristics by the sound image localization filters 11L and 11R in reality. This is usually due to a filter characteristic error that occurs from the necessity of setting the sound image localization filters 11L and 11R to a practical scale, an error in spatial acoustic signal synthesis caused by the fact that the usual listening position is not an ideal position, or the like. Particularly in this case, it is difficult to reproduce the first notch and the second notch of the head-related transfer function HL at the left ear EL, which should be reproduced only at one ear. However, since the first notch and the second notch of the head-related transfer function HR are applied to the entire signal, the reproducibility is good.

Now, hereinafter, consider the influences of the first notch and the second notch which appear in the head-related transfer functions G1 and G2 under such a situation.

The frequency bands of the first notch and the second notch of the head-related transfer function G1 generally do not coincide with the frequency bands of the first notch and the second notch of the head-related transfer function G2. Therefore, in a case where the volume of the speaker 12L and the volume of the speaker 12R are each significantly large, at the left ear EL of the listener P, the first notch and the second notch of the head-related transfer function G1 are canceled by the sound from the speaker 12R and the first notch and the second notch of the head-related transfer function G2 are canceled by the sound from the speaker 12L. Similarly, at the right ear ER of the listener P, the first notch and the second notch of the head-related transfer function G1 are canceled by the sound from the speaker 12L and the first notch and the second notch of the head-related transfer function G2 are canceled by the sound from the speaker 12R.

Therefore, the notches of the head-related transfer functions G1 and G2 do not appear at both ears of the listener P and do not influence the localization sensation of the virtual speaker 13, thereby stabilizing the up-down and front-back position of the virtual speaker 13.

On the other hand, for example, in a case where the volume of the speaker 12R becomes significantly smaller than the volume of the speaker 12L, the sound from the speaker 12R hardly reaches both ears of the listener P. Accordingly, the first notch and the second notch of the head-related transfer function G1 are not eliminated and remain intact at the left ear EL of the listener P. Also, the first notch and the second notch of the head-related transfer function G2 are not eliminated and remain intact at the right ear ER of the listener P.

Therefore, in the actual crosstalk correction processing, at the left ear EL of the listener P, the first notch and the second notch of the head-related transfer function G1 appear in addition to the notches of approximately the same frequency bands as the first notch and the second notch of the head-related transfer function HR. In other words, two sets of notches simultaneously occur. Also, at the right ear ER of the listener P, the first notch and the second notch of the head-related transfer function G2 appear in addition to the first notch and the second notch of the head-related transfer function HR. In other words, two sets of notches simultaneously occur.

The notches other than those of the head-related transfer functions HL and HR appear at both ears of the listener P in this way so that the effects of forming the notches of the same frequency bands as first notch and the second notch of the head-related transfer function HR in the acoustic signal Sin inputted into the sound image localization filter 11L are diminished. Then, it becomes difficult for the listener P to identify the position of the virtual speaker 13, and the up-down and front-back position of the virtual speaker 13 becomes unstable.

Here, a specific example in a case where the volume of the speaker 12R becomes significantly smaller than the volume of the speaker 12L will be described.

For example, in a case where the speaker 12L and the virtual speaker 13 are arranged about an arbitrary point on the axis passing both ears of the listener P and on the circumference of the same circle perpendicular to the axis or in the vicinity thereof, the gain of the sound image localization filter 11R becomes significantly smaller than the gain of the sound image localization filter 11L as described later.

Note that the axis passing both ears of the listener P is referred to as an interaural axis hereinafter. Moreover, a circle about an arbitrary point on the interaural axis and perpendicular to the interaural axis will be referred to as a circle around the interaural axis hereinafter. Note that the listener P cannot identify the position of the sound source on the circumference of the same circle around the interaural axis due to a phenomenon called cone of confusion in the field of spatial acoustics (e.g., see Non-Patent Document 1, pp. 16).

In this case, the level difference and the time difference of the sound from the speaker 12L between both ears of the listener P become approximately equal to the level difference and the time difference of the sound from the virtual speaker 13 between both ears of the listener P. Therefore, the following expressions (1) and (1') are established.

$$G2/G1 \approx HR/HL \quad (1)$$

$$HR \approx (G2*HL)/G1 \quad (1')$$

Note that the expression (1') is a modification of the expression (1).

On the other hand, coefficients CL and CR of the general sound image localization filters 11L and 11R are expressed by the following expressions (2-1) and (2-2).

$$CL=(G1*HL-G2*HR)/(G1*G1-G2*G2) \quad (2\text{-}1)$$

$$CR=(G1*HR-G2*HL)/(G1*G1-G2*G2) \quad (2\text{-}2)$$

Therefore, the following expressions (3-1) and (3-2) are established by the expression (1') as well as the expressions (2-1) and (2-2).

$$CL \approx HL/G1 \quad (3\text{-}1)$$

$$CR \approx 0 \quad (3\text{-}2)$$

In other words, the sound image localization filter 11L approximately becomes a difference between the head-related transfer function HL and the head-related transfer function G1. On the other hand, the output of the sound image localization filter 11R is approximately zero. Therefore, the volume of the speaker 12R becomes significantly smaller than the volume of the speaker 12L.

Summing up the above, in a case where the speaker 12L and the virtual speaker 13 are arranged on the circumference of the same circle around the interaural axis or in the vicinity thereof, the gain (coefficient CR) of the sound image localization filter 11R becomes significantly smaller than the gain (coefficient CL) of the sound image localization filter 11L. As a result, the volume of the speaker 12R becomes significantly smaller than the volume of the speaker 12L, and the up-down and front-back position of the virtual speaker 13 becomes unstable.

Note that this similarly applies to a case where the speaker 12R and the virtual speaker 13 are arranged on the circumference of the same circle around the interaural axis or in the vicinity thereof.

In contrast, the present technology makes it possible to stabilize the localization sensation of the virtual speaker even in a case where the volume of one speaker becomes significantly smaller than the volume of the other speaker.

2. First Embodiment

Next, a first embodiment of an acoustic signal processing system to which the present technology is applied will be described with reference to FIGS. 3 to 5.

{Configuration Example of Acoustic Signal Processing System 101L}

Figure 3:
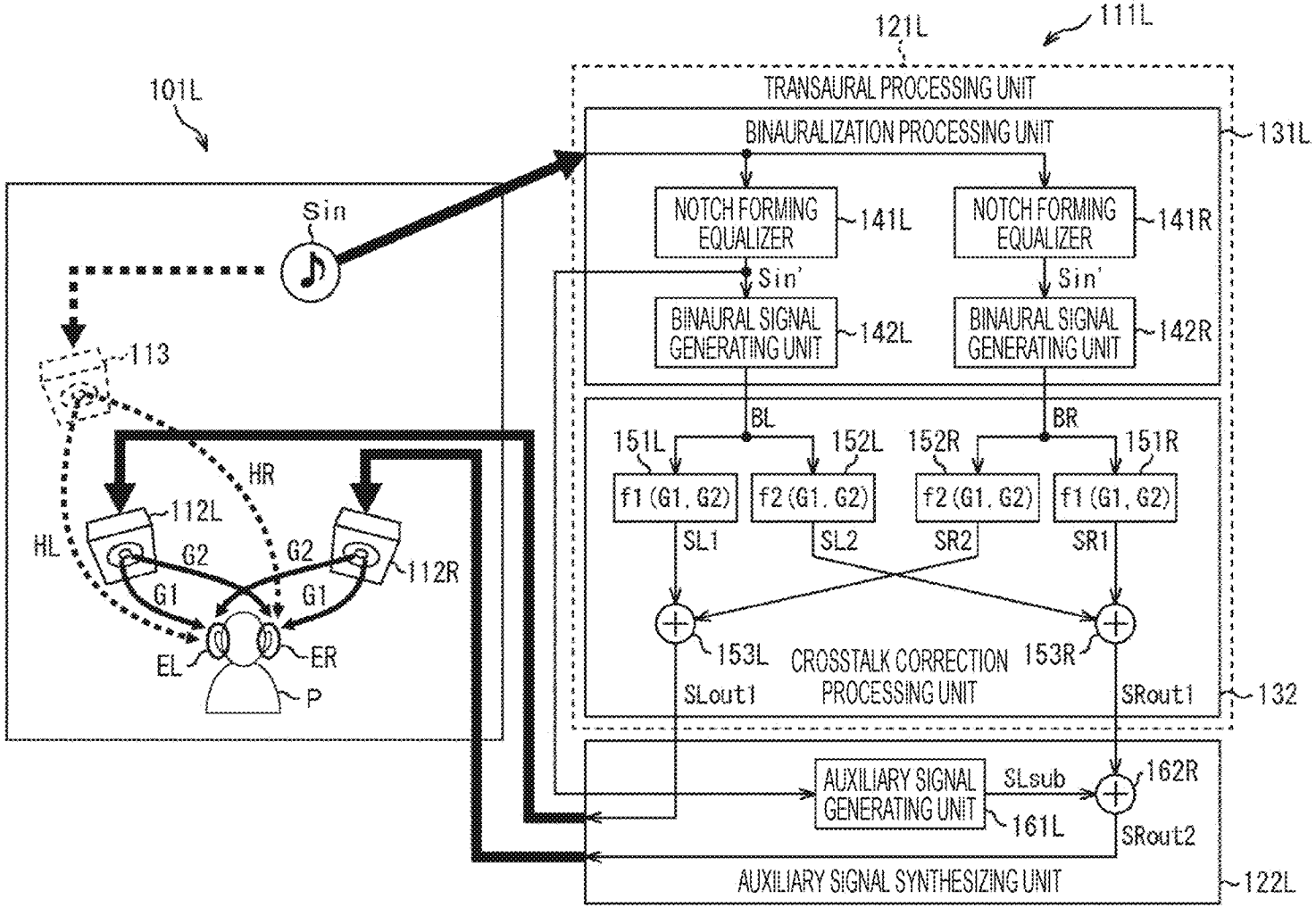
FIG. 3 is a diagram showing a first embodiment of an acoustic signal processing system to which the present technology is applied.

FIG. 3 is a diagram showing a configuration example of the functions of an acoustic signal processing system 101L which is the first embodiment of the present technology.

The acoustic signal processing system 101L is configured by including an acoustic signal processing unit 111L and speakers 112L and 112R. The speakers 112L and 112R are, for example, arranged left-right symmetrically at the front of an ideal predetermined listening position in the acoustic signal processing system 101L.

The acoustic signal processing system 101L realizes a virtual speaker 113, which is a virtual sound source, by using the speakers 112L and 112R. In other words, the acoustic signal processing system 101L can localize sound images, which are outputted from the respective speakers 112L and 112R to a listener P at a predetermined listening position, at a position of the virtual speaker 113 deviated to the left from the median plane.

Note that a case where the position of the virtual speaker 113 is set obliquely upward to the front left of the listening position (listener P) will be described hereinafter. In this case, a right ear ER of the listener P becomes a shadow side. Moreover, a case where the speaker 112L and the virtual speaker 113 are arranged on the circumference of the same circle around the interaural axis or in the vicinity thereof will be described hereinafter.

Furthermore, hereinafter, similar to the example in FIG. 2, the sound source side HRTF between the virtual speaker 113 and a left ear EL of the listener P is referred to as a head-related transfer function HL, and the sound source opposite side HRTF between the virtual speaker 113 and the right ear ER of the listener P is referred to as a head-related transfer function HR. Further, hereinafter, similar to the example in FIG. 2, the HRTF between the speaker 112L and the left ear EL of the listener P and the HRTF between the speaker 112R and the right ear ER of the listener P are regarded as the same, and the HRTFs are referred to as head-related transfer functions G1. Also, hereinafter, similar to the example in FIG. 2, the HRTF between the speaker 112L and the right ear ER of the listener P and the HRTF between the speaker 112R and the left ear EL of the listener P are regarded as the same, and the HRTFs are referred to as head-related transfer functions G2.

The acoustic signal processing unit 111L is configured by including a transaural processing unit 121L and an auxiliary signal synthesizing unit 122L. The transaural processing unit 121L is configured by including a binauralization processing unit 131L and a crosstalk correction processing unit 132. The binauralization processing unit 131L is configured by including notch forming equalizers 141L and 141R and binaural signal generating units 142L and 142R. The crosstalk correction processing unit 132 is configured by including signal processing units 151L and 151R, signal processing units 152L and 152R and adding units 153L and 153R. The auxiliary signal synthesizing unit 122L is configured by including an auxiliary signal generating unit 161L and an adding unit 162R.

The notch forming equalizer 141L performs processing (hereinafter, referred to as notch forming processing) for attenuating the components of the frequency bands in which the first notch and the second notch appear in the sound source opposite side HRTF (head-related transfer function HR) among the components of an acoustic signal Sin inputted from the outside. The notch forming equalizer 141L supplies an acoustic signal Sin' obtained as a result of the notch forming processing to the binaural signal generating unit 142L and the auxiliary signal generating unit 161L.

The notch forming equalizer 141R is an equalizer similar to the notch forming equalizer 141L. Therefore, the notch forming equalizer 141R performs notch forming processing for attenuating the components of the frequency bands in which the first notch and the second notch appear in the sound source opposite side HRTF (head-related transfer function HR) among the components of the acoustic signal Sin. The notch forming equalizer 141R supplies the acoustic signal Sin' obtained as a result of the notch forming processing to the binaural signal generating unit 142R.

The binaural signal generating unit 142L generates a binaural signal BL by superimposing the head-related transfer function HL on the acoustic signal Sin'. The binaural signal generating unit 142L supplies the generated binaural signal BL to the signal processing unit 151L and the signal processing unit 152L.

The binaural signal generating unit 142R generates a binaural signal BR by superimposing the head-related transfer function HR on the acoustic signal Sin'. The binaural signal generating unit 142R supplies the generated binaural signal BR to the signal processing unit 151R and the signal processing unit 152R.

The signal processing unit 151L generates an acoustic signal SL1 by superimposing, on the binaural signal BL, a predetermined function f1 (G1, G2) with the head-related transfer functions G1 and G2 as variables. The signal processing unit 151L supplies the generated acoustic signal SL1 to the adding unit 153L.

Similarly, the signal processing unit 151R generates an acoustic signal SR1 by superimposing the function f1 (G1, G2) on the binaural signal BR. The signal processing unit 151R supplies the generated acoustic signal SR1 to the adding unit 153R.

Note that the function f1 (G1, G2) is expressed, for example, by the following expression (4).

$$f1(G1,G2)=1/(G1+G2)+1/(G1-G2) \quad (4)$$

The signal processing unit 152L generates an acoustic signal SL2 by superimposing, on the binaural signal BL, a predetermined function f2 (G1, G2) with the head-related transfer functions G1 and G2 as variables. The signal processing unit 152L supplies the generated acoustic signal SL2 to the adding unit 153R.

Similarly, the signal processing unit 152R generates an acoustic signal SR2 by superimposing the function f2 (G1, G2) on the binaural signal BR. The signal processing unit 152R supplies the generated acoustic signal SR2 to the adding unit 153L.

Note that the function f2 (G1, G2) is expressed, for example, by the following expression (5).

$$f2(G1,G2)=1/(G1+G2)-1/(G1-G2) \quad (5)$$

The adding unit 153L generates an acoustic signal SLout1 by adding the acoustic signal SL1 and the acoustic signal SR2. The adding unit 153L supplies the acoustic signal SLout1 to the speaker 112L.

The adding unit 153R generates an acoustic signal SRout1 by adding the acoustic signal SR1 and the acoustic signal SL2. The adding unit 153R supplies the acoustic signal SRout1 to the adding unit 162R.

The auxiliary signal generating unit 161L includes, for example, a filter (e.g., a high-pass filter, a band-pass filter, or the like), which extracts or attenuates a signal of a predetermined frequency band, and an attenuator which adjusts the signal level. The auxiliary signal generating unit 161L generates an auxiliary signal SLsub by extracting or attenuating the signal of the predetermined frequency band of the acoustic signal Sin' supplied from the notch forming equalizer 141L and adjusts the signal level of the auxiliary signal SLsub as necessary. The auxiliary signal generating unit 161L supplies the generated auxiliary signal SLsub to the adding unit 162R.

The adding unit 162R generates an acoustic signal SRout2 by adding the acoustic signal SRout1 and the auxiliary signal SLsub. The adding unit 162R supplies the acoustic signal SRout2 to the speaker 112R.

The speaker 112L outputs a sound based on the acoustic signal SLout1, and the speaker 112R outputs a sound based on the acoustic signal SRout2 (i.e., the signal obtained by synthesizing the acoustic signal SRout1 and the auxiliary signal SLsub).

{Acoustic Signal Processing by Acoustic Signal Processing System 101L}

Next, the acoustic signal processing executed by the acoustic signal processing system 101L in FIG. 3 will be described with reference to the flowchart in FIG. 4.

In Step S1, the notch forming equalizers 141L and 141R form, in the acoustic signals Sin on the sound source side and the sound source opposite side, the notches of the same frequency bands as the notches of the sound source opposite side HRTF. In other words, the notch forming equalizer 141L attenuates the components of the same frequency bands as the first notch and the second notch of the head-related transfer function HR, which is the sound source opposite side HRTF of the virtual speaker 113, among the components of the acoustic signal Sin. Accordingly, among the components of the acoustic signal Sin, attenuated are the components of the lowest frequency band and the second lowest frequency band at a predetermined frequency (a frequency at which a positive peak in the vicinity of 4 kHz appears) or more of the frequency bands in which the notches of the head-related transfer function HR appear. Then, the notch forming equalizer 141L supplies the acoustic signal Sin' obtained as a result to the binaural signal generating unit 142L and the auxiliary signal generating unit 161L.

Similarly, the notch forming equalizer 141R attenuates the components of the same frequency bands as the first notch and the second notch of the head-related transfer function HR among the components of the acoustic signal Sin. Then, the notch forming equalizer 141R supplies the acoustic signal Sin' obtained as a result to the binaural signal generating unit 142R.

In Step S2, the binaural signal generating units 142L and 142R perform the binauralization processing. Specifically, the binaural signal generating unit 142L generates the binaural signal BL by superimposing the head-related transfer function HL on the acoustic signal Sin'. The binaural signal generating unit 142L supplies the generated binaural signal BL to the signal processing unit 151L and the signal processing unit 152L.

This binaural signal BL becomes a signal obtained by superimposing, on the acoustic signal Sin, the HRTF, in which the notches of the same frequency bands as the first notch and the second notch of the sound source opposite side HRTF (head-related transfer function HR) are formed in the sound source side HRTF (head-related transfer function HL). In other words, this binaural signal BL is a signal obtained by attenuating the components of the frequency bands, in which the first notch and the second notch appear in the sound source opposite side HRTF, among the components of the signal obtained by superimposing the sound source side HRTF on the acoustic signal Sin.

Similarly, the binaural signal generating unit 142R generates the binaural signal BR by superimposing the head-related transfer function HR on the acoustic signal Sin'. The binaural signal generating unit 142R supplies the generated binaural signal BR to the signal processing unit 151R and the signal processing unit 152R.

This binaural signal BR becomes a signal obtained by superimposing, on the acoustic signal Sin, the HRTF, in which the first notch and second notch of the sound source opposite side HRTF (head-related transfer function HR) are substantially further deepened. Therefore, in this binaural signal BR, the components of the frequency bands, in which the first notch and the second notch appear in the sound source opposite side HRTF, are further reduced.

In Step S3, the crosstalk correction processing unit 132 performs the crosstalk correction processing. Specifically, the signal processing unit 151L generates the acoustic signal SL1 by superimposing the above-described function f1 (G1, G2) on the binaural signal BL. The signal processing unit 151L supplies the generated acoustic signal SL1 to the adding unit 153L.

Similarly, the signal processing unit 151R generates an acoustic signal SR1 by superimposing the function f1 (G1, G2) on the binaural signal BR. The signal processing unit 151R supplies the generated acoustic signal SR1 to the adding unit 153R.

Moreover, the signal processing unit 152L generates the acoustic signal SL2 by superimposing the above-described function f2 (G1, G2) on the binaural signal BL. The signal processing unit 152L supplies the generated acoustic signal SL2 to the adding unit 153R.

Similarly, the signal processing unit 152R generates an acoustic signal SR2 by superimposing the function f2 (G1, G2) on the binaural signal BR. The signal processing unit 152R supplies the generated acoustic signal SL2 to the adding unit 153L.

The adding unit 153L generates the acoustic signal SLout1 by adding the acoustic signal SL1 and the acoustic signal SR2. Here, since the components of the frequency bands, in which the first notch and the second notch appear in the sound source opposite side HRTF, are attenuated in the acoustic signal Sin' by the notch forming equalizer 141L, the components of the same frequency bands are also attenuated in the acoustic signal SLout1. The adding unit 153L supplies the generated acoustic signal SLout1 to the speaker 112L.

Similarly, the adding unit 153R generates the acoustic signal SRout1 by adding the acoustic signal SR1 and the acoustic signal SL2. Here, in the acoustic signal SRout1, the components of the frequency bands, in which the first notch and the second notch of the sound source opposite side HRTF appear, are reduced. Furthermore, since the components of the frequency bands, in which the first notch and the second notch appear in the sound source opposite side HRTF, are attenuated in the acoustic signal Sin' by the notch forming equalizer 141R, the components of the same frequency bands are further reduced in the acoustic signal SLout1. The adding unit 153R supplies the generated acoustic signal SRout1 to the adding unit 162R.

Here, as described above, since the speaker 112L and the virtual speaker 113 are arranged on the circumference of the same circle around the interaural axis or in the vicinity thereof, the magnitude of the acoustic signal SRout1 is relatively smaller than that of the acoustic signal SLout1.

In Step S4, the auxiliary signal synthesizing unit 122L performs the auxiliary signal synthesizing processing. Specifically, the auxiliary signal generating unit 161L generates the auxiliary signal SLsub by extracting or attenuating the signal of the predetermined frequency band of the acoustic signal Sin'.

For example, the auxiliary signal generating unit 161L attenuates the frequency bands of less than 4 kHz of the acoustic signal Sin', thereby generating the auxiliary signal SLsub including the components of the frequency bands of 4 kHz or more of the acoustic signal SLout1.

Alternatively, for example, the auxiliary signal generating unit 161L generates the auxiliary signal SLsub by extracting the components of a predetermined frequency band among the frequency bands of 4 kHz or more from the acoustic signal Sin'. The frequency band extracted here includes at least the frequency bands in which the first notch and the second notch of the head-related transfer function G1, or the frequency bands in which the first notch and the second notch of the head-related transfer function G2 appear.

Note that, in a case where the HRTF between the speaker 112L and the left ear EL and the HRTF between the speaker 112R and the right ear ER are different and the HRTF between the speaker 112L and the right ear ER and the HRTF between the speaker 112R and the left ear EL are different, the frequency bands, in which the first notches and the second notches of the respective HRTFs appear, may be included at least in the frequency band of the auxiliary signal SLsub.

Moreover, the auxiliary signal generating unit 161L adjusts the signal level of the auxiliary signal SLsub as necessary. Then, the auxiliary signal generating unit 161L supplies the generated auxiliary signal SLsub to the adding unit 162R.

The adding unit 162R generates the acoustic signal SRout2 by adding the auxiliary signal SLsub to the acoustic signal SRout1. The adding unit 162R supplies the generated acoustic signal SRout2 to the speaker 112R.

Accordingly, even if the level of the acoustic signal SRout1 is relatively smaller than that of the acoustic signal SLout1, the level of the acoustic signal SRout2 becomes significantly large with respect to the acoustic signal SLout1 at least in the frequency bands in which the first notch and the second notch of the head-related transfer function G1 and the first notch of the head-related transfer function G2 appear. On the other hand, the level of the acoustic signal SRout2 becomes very small in the frequency bands in which the first notch and the second notch of the head-related transfer function HR appear.

In Step S5, the sounds based on the acoustic signal SLout1 or the acoustic signal SRout2 are outputted from the speaker 112L and the speaker 112R, respectively.

Accordingly, paying attention to only the frequency bands of the first notch and the second notch of the sound source opposite side HRTF (head-related transfer function HR), the signal levels of the reproduced sounds of the speakers 112L and 112R decrease, and the levels of the frequency bands stably decrease in the sounds reaching both ears of the listener P. Therefore, even if crosstalk occurs, the first notch and the second notch of the sound source opposite side HRTF are stably reproduced at the ear of the listener P on the shadow side.

Moreover, in the frequency bands in which the first notch and the second notch of the head-related transfer function G1 and the first notch and the second notch of the head-related transfer function G2 appear, the levels of the sound outputted from the speaker 112L and the sound outputted from the speaker 112R become significantly large to each other. Therefore, the first notch and the second notch of the head-related transfer function G1 and the first notch and the second notch of the head-related transfer function G2 cancel each other and do not appear at both ears of the listener P.

Therefore, even if the speaker 112L and the virtual speaker 113 are arranged on the circumference of the same circle around the interaural axis or in the vicinity thereof and the level of the acoustic signal SRout1 becomes significantly smaller than that of the acoustic signal SLout1, the up-down and front-back position of the virtual speaker 113 can be stabilized.

Furthermore, the auxiliary signal SLsub is generated by using the acoustic signal SLout1 outputted from the cross-talk correction processing unit 132 in the above-described Patent Document 2, whereas the auxiliary signal SLsub is generated by using the acoustic signal Sin' outputted from the notch forming equalizer 141L in the acoustic signal processing system 101L. This widens the variations of the configuration of the acoustic signal processing system 101 and facilitates circuit design and the like.

Note that it is also assumed that the size of the sound image slightly expands in the frequency band of the auxiliary signal SLsub due to the influence of the auxiliary signal SLsub. However, if the auxiliary signal SLsub is at an appropriate level, the influence is insignificant since the body of the sound is basically formed in the low to mid frequency bands. However, it is desirable that the level of the auxiliary signal SLsub be adjusted as small as possible within a range in which the effects of stabilizing the localization sensation of the virtual speaker 113 are obtained.

Further, as previously described, in the binaural signal BR, the components of the frequency bands in which the first notch and the second notch appear in the sound source opposite side HRTF (head-related transfer function HR) are reduced. Therefore, the components of the same frequency bands of the acoustic signal SRout2 finally supplied to the speaker 112R are also reduced, and the level of the same frequency bands of the sound outputted from the speaker 112R are also reduced.

However, this does not have an adverse influence in terms of stable reproduction of the levels of the frequency bands of the first notch and the second notch of the sound source opposite side HRTF at the ear of the listener P on the shadow side. Therefore, it is possible to obtain the effects of stabilizing the up-down and front-back localization sensation in the acoustic signal processing system 101L.

In addition, since the levels of the frequency bands of the first notch and the second notch of the sound source opposite side HRTF are originally small in the sound reaching both ears of the listener P, even if the levels are further reduced, the sound quality is not adversely influenced.

Modification Examples of First Embodiment

Hereinafter, modification examples of the first embodiment will be described.

Modification Example Relating to Notch Forming Equalizer 141

For example, it is possible to change the position of the notch forming equalizer 141L. For example, the notch forming equalizer 141L can be arranged between the binaural signal generating unit 142L and the bifurcation point before the signal processing unit 151L and the signal processing unit 152L. Further, for example, the notch forming equalizer 141L can be arranged at two places between the signal processing unit 151L and the adding unit 153L and between the signal processing unit 152L and the adding unit 153R.

Furthermore, it is possible to change the position of the notch forming equalizer 141R. For example, the notch forming equalizer 141R can be arranged between the binaural signal generating unit 142R and the bifurcation point before the signal processing unit 151R and the signal processing unit 152R. Further, for example, the notch forming equalizer 141R can be arranged at two places between the signal processing unit 151R and the adding unit 153R and between the signal processing unit 152R and the adding unit 153L.

Moreover, the notch forming equalizer 141R can be eliminated.

Furthermore, for example, it is also possible to combine the notch forming equalizer 141L and the notch forming equalizer 141R into one.

Modification Example Relating to Auxiliary Signal SLsub

For example, the auxiliary signal generating unit 161L can generate the auxiliary signal SLsub by using a signal other than the acoustic signal Sin' outputted from the notch forming equalizer 141L by a method similar to that of the case of using the acoustic signal Sin'.

For example, it is possible to use a signal (e.g., the binaural signal BL, the acoustic signal SL1 or the acoustic signal SL2) between the binaural signal generating unit 142L and the adding unit 153L or the adding unit 153R. However, in a case where the position of the notch forming equalizer 141L is changed as previously described, a signal after the notch forming processing is performed by the notch forming equalizer 141L is used.

Moreover, for example, it is possible to use the acoustic signal Sin' outputted from the notch forming equalizer 141R.

Furthermore, for example, it is possible to use a signal (e.g., the binaural signal BR, the acoustic signal SR1 or the acoustic signal SR2) between the binaural signal generating unit 142R and the adding unit 153L or the adding unit 153R. Note that this similarly applies to the case where the notch forming equalizer 141R is eliminated or the case where the position of the notch forming equalizer 141R is changed.

As described above, by changing the positions or the like of the notch forming equalizers 141L and 141R or by changing the signal used for generating the auxiliary signal SLsub, the variations of the configuration of the acoustic signal processing system 101L are widened, and circuit design and the like are facilitated.

Figure 5:
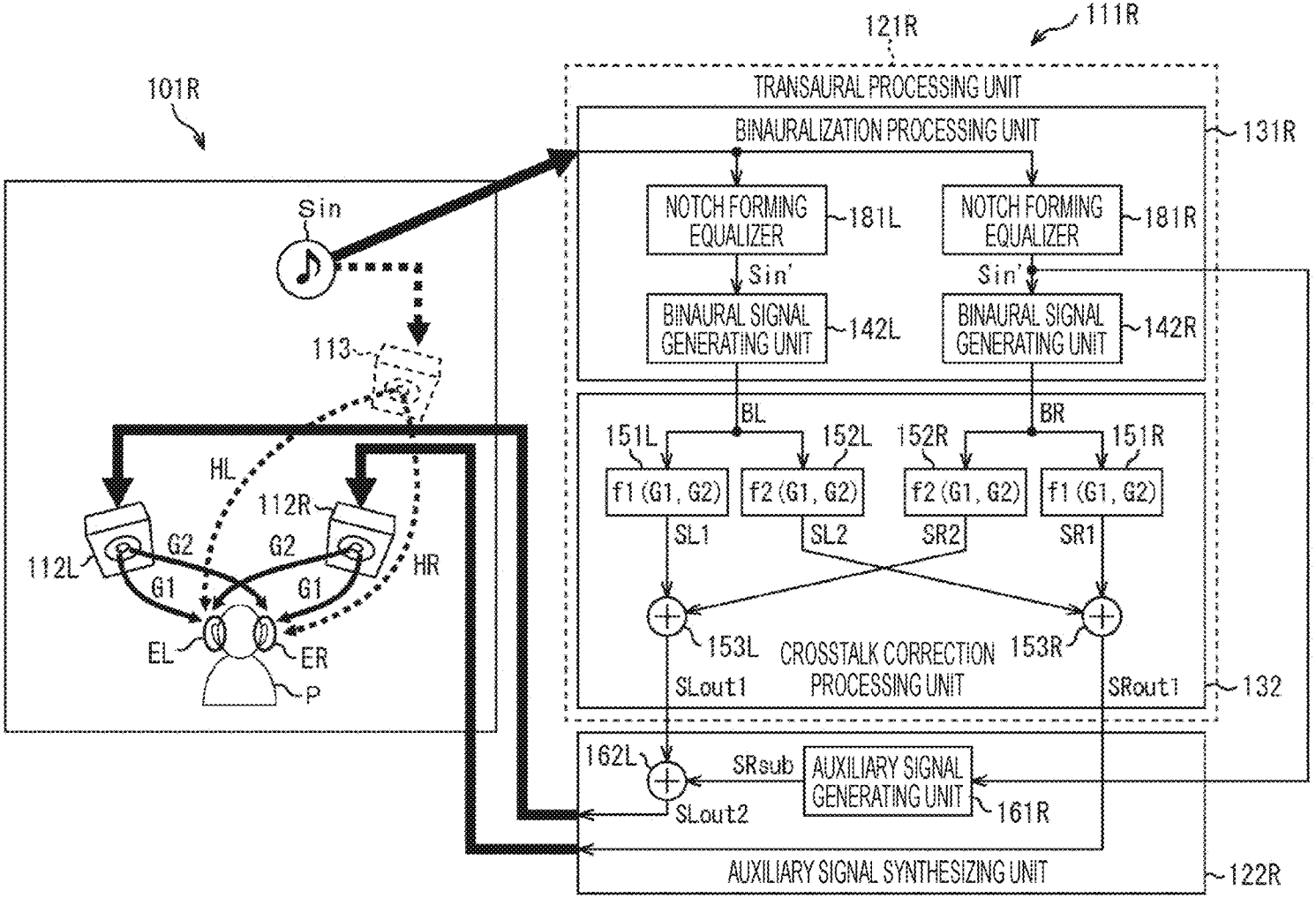
FIG. 5 is a diagram showing a modification example of the first embodiment of the acoustic signal processing system to which the present technology is applied.

MODIFICATION EXAMPLE IN CASE WHERE VIRTUAL SPEAKER is Localized at Position Deviated to Right from Median Plane of Listener FIG. 5 is a diagram showing a configuration example of the functions of an acoustic signal processing system 101R which is a modification example of the first embodiment of the present technology. Note that, in the drawing, parts corresponding to those in FIG. 3 are denoted by the same reference signs, and parts with the same processings are omitted as appropriate to omit the redundant explanations.

In contrast to the acoustic signal processing system 101L in FIG. 3, an acoustic signal processing system 101R is a system that localizes the virtual speaker 113 at a position deviated to the right from the median plane of the listener P at the predetermined listening position. In this case, the left ear EL of the listener P becomes the shadow side.

The acoustic signal processing system 101R is different from the acoustic signal processing system 101L in that an acoustic signal processing unit 111R is provided instead of the acoustic signal processing unit 111L. The acoustic signal processing unit 111R is different from the acoustic signal processing unit 111L in that a transaural processing unit 121R and an auxiliary signal synthesizing unit 122R are provided instead of the transaural processing unit 121L and the auxiliary signal synthesizing unit 122L. The transaural processing unit 121R is different from the transaural processing unit 121L in that a binauralization processing unit 131R is provided instead of the binauralization processing unit 131L.

The binauralization processing unit 131R is different from the binauralization processing unit 131L in that notch forming equalizers 181L and 181R are provided instead of the notch forming equalizers 141L and 141R.

The notch forming equalizer 181L performs processing (notch forming processing) for attenuating the components of the frequency bands in which the first notch and the second notch appear in the sound source opposite side HRTF (head-related transfer function HL) among the components of the acoustic signal Sin. The notch forming equalizer 181L supplies an acoustic signal Sin' obtained as a result of the notch forming processing to a binaural signal generating unit 142L.

The notch forming equalizer 181R has functions similar to those of the notch forming equalizer 181L and performs notch forming processing for attenuating the components of the frequency bands in which the first notch and the second notch appear in the sound source opposite side HRTF (head-related transfer function HL) among the components of the acoustic signal Sin. The notch forming equalizer 181R supplies an acoustic signal Sin' obtained as a result to the binaural signal generating unit 142R and an auxiliary signal generating unit 161R.

The auxiliary signal synthesizing unit 122R is different from the auxiliary signal synthesizing unit 122L in that the auxiliary signal generating unit 161R and an adding unit 162L are provided instead of the auxiliary signal generating unit 161L and the adding unit 162R.

The auxiliary signal generating unit 161R has functions similar to those of the auxiliary signal generating unit 161L, generates an auxiliary signal SRsub by extracting or attenuating the signal of the predetermined frequency band of the acoustic signal Sin' supplied from the notch forming equalizer 141R and adjusts the signal level of the auxiliary signal SRsub as necessary. The auxiliary signal generating unit 161R supplies the generated auxiliary signal SRsub to the adding unit 162L.

The adding unit 162L generates an acoustic signal SLout2 by adding an acoustic signal SLout1 and the auxiliary signal SRsub. The adding unit 162L supplies the acoustic signal SLout2 to a speaker 112L.

Then, the speaker 112L outputs a sound based on the acoustic signal SLout2, and a speaker 112R outputs a sound based on an acoustic signal SRout1.

Accordingly, the acoustic signal processing system 101R can stably localize the virtual speaker 113 at the position deviated to the right from the median plane of the listener P at the predetermined listening position by a method similar to that of the acoustic signal processing system 101L.

Note that, also in the transaural processing unit 121R, similar to the transaural processing unit 121L in FIG. 3, the positions of the notch forming equalizer 181R and the notch forming equalizer 181R can be changed.

Moreover, for example, the notch forming equalizer 181L can be eliminated.

Furthermore, for example, it is also possible to combine the notch forming equalizer 181L and the notch forming equalizer 181R into one.

Further, similar to the auxiliary signal generating unit 161L in FIG. 3, the auxiliary signal generating unit 161R can also change the signal used for generating the auxiliary signal SRsub.

3. Second Embodiment

Next, a second embodiment of the acoustic signal processing system to which the present technology is applied will be described with reference to FIGS. 6 to 8.

{Configuration Example of Acoustic Signal Processing System 301L}

Figure 6:
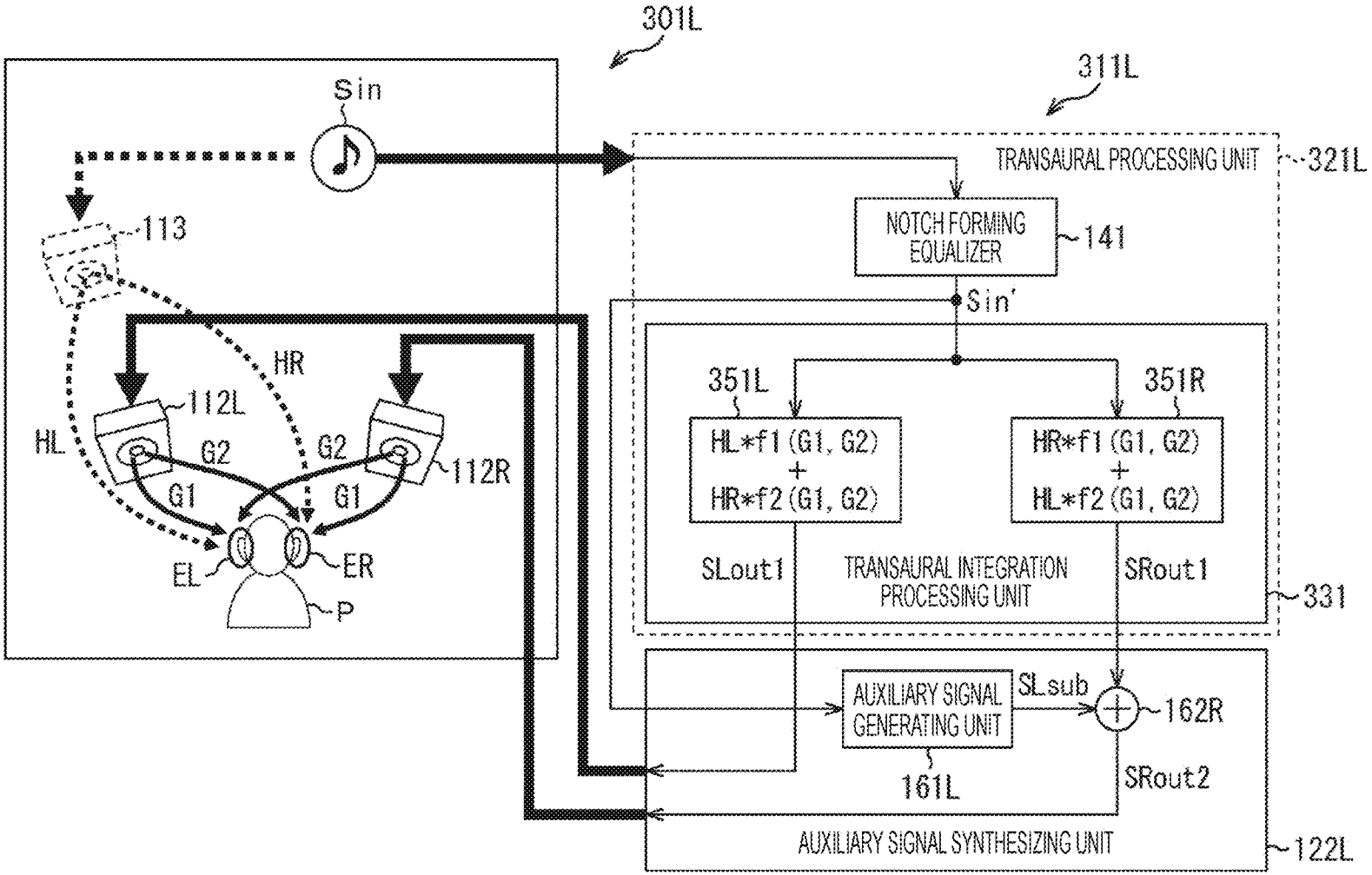
FIG. 6 is a diagram showing a second embodiment of an acoustic signal processing system to which the present technology is applied.
Figure 7:
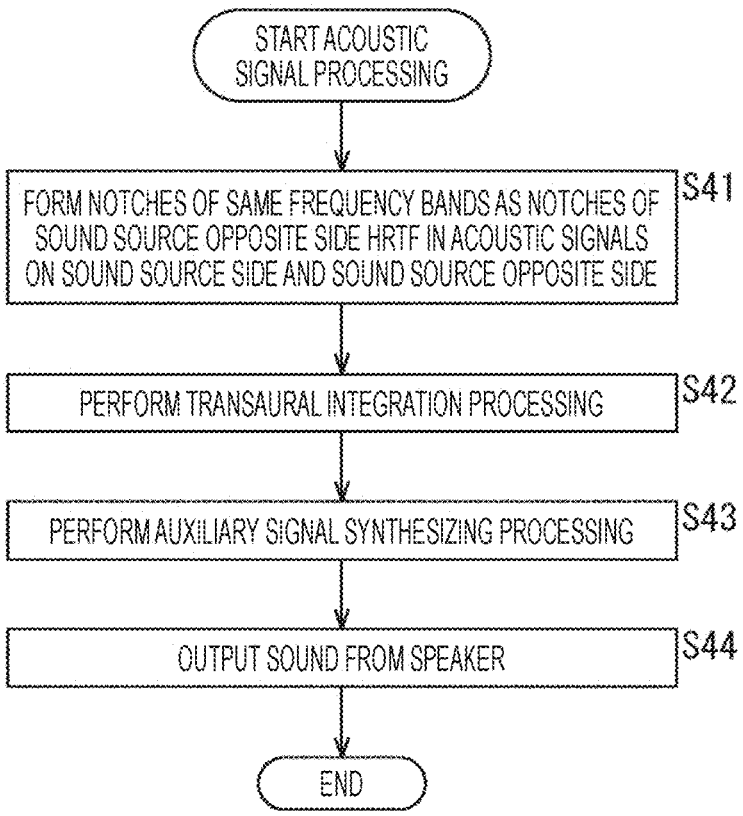
FIG. 7 is a flowchart for explaining the acoustic signal processing executed by the acoustic signal processing system of the second embodiment.

FIG. 6 is a diagram showing a configuration example of the functions of an acoustic signal processing system 301L which is the second embodiment of the present technology. Note that, in the drawing, parts corresponding to those in FIG. 3 are denoted by the same reference signs, and parts with the same processings are omitted as appropriate to omit the redundant explanations.

Similar to the acoustic signal processing system 101L of FIG. 3, the acoustic signal processing system 301L is a system that can localize a virtual speaker 113 at a position deviated to the left from the median plane of a listener P at a predetermined listening position.

The acoustic signal processing system 301L is different from the acoustic signal processing system 101L in that an acoustic signal processing unit 311L is provided instead of the acoustic signal processing unit 111L. The acoustic signal processing unit 311L is different from the acoustic signal processing unit 111L in that a transaural processing unit 321L is provided instead of the transaural processing unit 121L. The transaural processing unit 321L is configured by including a notch forming equalizer 141 and a transaural integration processing unit 331. The transaural integration processing unit 331 is configured by including signal processing units 351L and 351R.

The notch forming equalizer 141 is an equalizer similar to the notch forming equalizers 141L and 141R in FIG. 3. Therefore, an acoustic signal Sin' similar to those of the notch forming equalizers 141L and 141R is outputted from the notch forming equalizer 141 and supplied to the signal processing units 351L and 351R and an auxiliary signal generating unit 161L.

The transaural integration processing unit 331 performs integration processing of binauralization processing and crosstalk correction processing on the acoustic signal Sin'. For example, the signal processing unit 351L conducts the processing represented by the following expression (6) on the acoustic signal Sin' and generates an acoustic signal SLout1.

$$SLout1=\{HL*f1(G1,G2)+HR*f2(G1,G2)\}\times Sin' \quad (6)$$

This acoustic signal SLout1 becomes the same signal as the acoustic signal SLout1 in the acoustic signal processing system 101L.

Similarly, for example, the signal processing unit 351R conducts the processing represented by the following expression (7) on the acoustic signal Sin' and generates an acoustic signal SRout1.

$$SRout1=\{HR*f1(G1,G2)+HL*f2(G1,G2)\}\times Sin' \quad (7)$$

This acoustic signal SRout1 becomes the same signal as the acoustic signal SRout1 in the acoustic signal processing system 101L.

Note that, in a case where the notch forming equalizer 141 is mounted on the outside of the signal processing units 351L and 351R, there is no path for performing the notch forming processing only on the acoustic signal Sin on the sound source side. Therefore, in the acoustic signal processing unit 311L, the notch forming equalizer 141 is provided before the signal processing unit 351L and the signal processing unit 351R, and the acoustic signals Sin on both the sound source side and the sound source opposite side are subjected to the notch forming processing and supplied to the signal processing units 351L and 351R. In other words, similar to the acoustic signal processing system 101L, the HRTF, in which the first notch and the second notch of the sound source opposite side HRTF are substantially further deepened, is superimposed on the acoustic signal Sin on the sound source opposite side.

However, as previously described, even if the first notch and the second notch of the sound source opposite side HRTF are further deepened, there is no adverse influence on the up-down and front-back localization sensation or the sound quality.

{Acoustic Signal Processing by Acoustic Signal Processing System 301L}

Next, the acoustic signal processing executed by the acoustic signal processing system 301L in FIG. 6 will be described with reference to the flowchart in FIG. 7.

In Step S41, the notch forming equalizer 141 forms, in the acoustic signals Sin on the sound source side and the sound source opposite side, the notches of the same frequency bands as the notches of the sound source opposite side HRTF. In other words, the notch forming equalizer 141 attenuates the components of the same frequency bands as the first notch and the second notch of the sound source opposite side HRTF (head-related transfer function HR) among the components of the acoustic signals Sin. The notch forming equalizer 141 supplies the acoustic signal Sin' obtained as a result to the signal processing units 351L and 351R and the auxiliary signal generating unit 161L.

In Step S42, the transaural integration processing unit 331 performs the transaural integration processing. Specifically, the signal processing unit 351L performs the integration processing of the binauralization processing and the crosstalk correction processing represented by the above-described expression (6) on the acoustic signal Sin' and generates the acoustic signal SLout1. Here, since the components of the frequency bands, in which the first notch and the second notch appear in the sound source opposite side HRTF, are attenuated in the acoustic signal Sin' by the notch forming equalizer 141, the components of the same frequency bands are also attenuated in the acoustic signal SLout1. Then, the signal processing unit 351L supplies the acoustic signal SLout1 to the speaker 112L.

Similarly, the signal processing unit 351R performs the integration processing of the binauralization processing and the crosstalk correction processing represented by the above-described expression (7) on the acoustic signal Sin' and generates the acoustic signal SRout1. Here, in the acoustic signal SRout1, the components of the frequency bands, in which the first notch and the second notch of the sound source opposite side HRTF appear, are reduced. Moreover, since the components of the frequency bands, in which the first notch and the second notch appear in the sound source opposite side HRTF, are attenuated in the acoustic signal Sin' by the notch forming equalizer 141, the components of the same frequency bands are further reduced in the acoustic signal SLout1. Then, the signal processing unit 351R supplies the acoustic signal SRout1 to the adding unit 162R.

Figure 4:
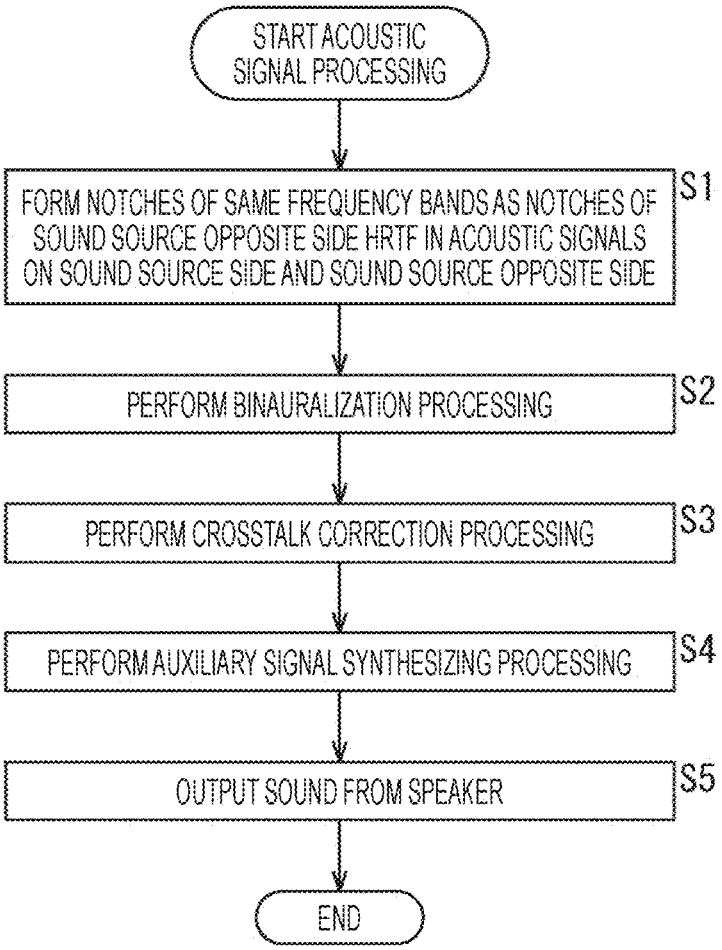
FIG. 4 is a flowchart for explaining the acoustic signal processing executed by the acoustic signal processing system of the first embodiment.

In Steps S43 and S44, processings similar to those in Steps S4 and S5 in FIG. 4 are performed, and the acoustic signal processing ends.

Accordingly, also in the acoustic signal processing system 301L, it is possible to stabilize the up-down and front-back localization sensation of the virtual speaker 113 for reasons similar to those of the acoustic signal processing system 101L. Furthermore, compared to the acoustic signal processing system 101L, it is generally expected that the load of the signal processing is reduced.

Further, the auxiliary signal SLsub is generated by using the acoustic signal SLout1 outputted from the transaural integration processing unit 331 in the above-described Patent Document 2, whereas the auxiliary signal SLsub is generated by using the acoustic signal Sin' outputted from the notch forming equalizer 141 in the acoustic signal processing system 301L. This widens the variations of the configuration of the acoustic signal processing system 301L and facilitates circuit design and the like.

Modification Examples of Second Embodiment

Hereinafter, a modification example of the second embodiment will be described.

Modification Example Relating to Notch Forming Equalizer

For example, it is possible to change the position of the notch forming equalizer 141. For example, the notch forming equalizer 141 can be arranged at two places subsequent to the signal processing unit 351L and subsequent to the signal processing unit 351R. In this case, the auxiliary signal generating unit 161L can generate the auxiliary signal SLsub by using a signal outputted from the notch forming equalizer 141 subsequent to the signal processing unit 351L by a method similar to that of the case of using the acoustic signal Sin'.

By changing the position of the notch forming equalizer 141 or by changing the signal used for generating the auxiliary signal SLsub in this way, the variations of the configuration of the acoustic signal processing system 301L are widened, and circuit design and the like are facilitated.

Figure 8:
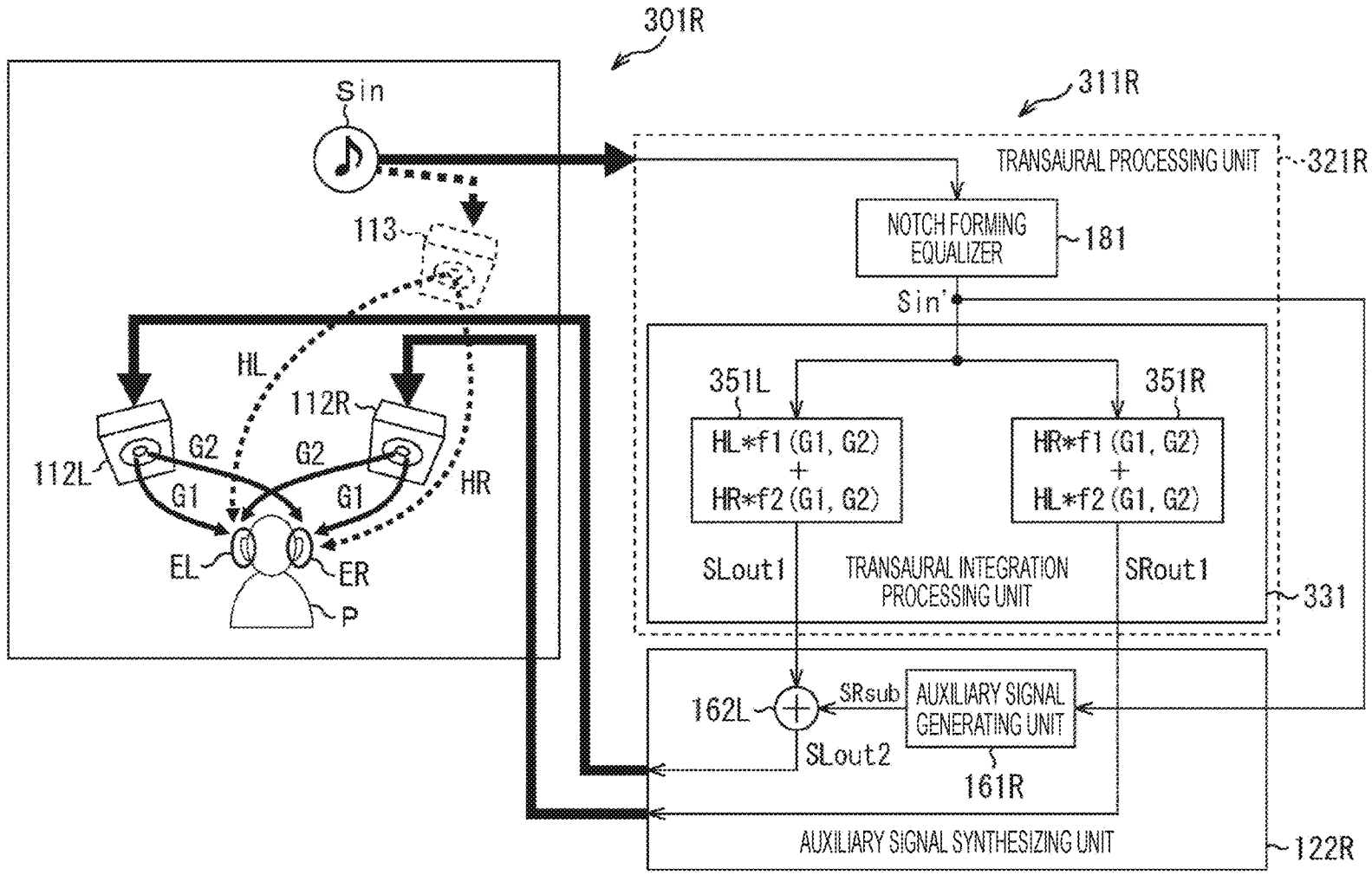
FIG. 8 is a diagram showing a modification example of the second embodiment of the acoustic signal processing system to which the present technology is applied.

Modification Example in Case where Virtual Speaker is Localized at Position Deviated to Right from Median Plane of Listener FIG. 8 is a diagram showing a configuration example of the functions of an acoustic signal processing system 301R which is a modification example of the second embodiment of the present technology. Note that, in the drawing, parts corresponding to those in FIGS. 5 and 6 are denoted by the same reference signs, and parts with the same processings are omitted as appropriate to omit the redundant explanations.

The acoustic signal processing system 301R is different from the acoustic signal processing system 301L in FIG. 6 in that the auxiliary signal synthesizing unit 122R of FIG. 5 and a transaural processing unit 321R are provided instead of the auxiliary signal synthesizing unit 122L and the transaural processing unit 321L. The transaural processing unit 321R is different from the transaural processing unit 321L in that a notch forming equalizer 181 is provided instead of the notch forming equalizer 141.

The notch forming equalizer 181 is an equalizer similar to the notch forming equalizers 181L and 181R in FIG. 5.

Therefore, an acoustic signal Sin' similar to those of the notch forming equalizers 181L and 181R is outputted from the notch forming equalizer 181 and supplied to signal processing units 351L and 351R and an auxiliary signal generating unit 161R.

Accordingly, the acoustic signal processing system 301R can stably localize a virtual speaker 113 at a position deviated to the right from the median plane of the listener P by a method similar to that of the acoustic signal processing system 301L.

Note that, also in the transaural processing unit 321R, similar to the transaural processing unit 321L in FIG. 6, the position of the notch forming equalizer 181 can be changed.

4. Third Embodiment

In the above description, the example in which the virtual speaker (virtual sound source) is generated at only one place has been shown, but the virtual speaker can be generated at two or more places.

For example, it is possible to generate the virtual speakers at each place of right and left positions separated with reference to the median plane of the listener. In this case, for example, with any one of combinations of the acoustic signal processing unit 111L in FIG. 3 and the acoustic signal processing unit 111R in FIG. 5 or the acoustic signal processing unit 311L in FIG. 6 and the acoustic signal processing unit 311R in FIG. 8, each acoustic signal processing unit may be provided in parallel for each virtual speaker.

Note that, in a case where a plurality of acoustic signal processing units are provided in parallel, a sound source side HRTF and a sound source opposite side HRTF for each virtual speaker are applied to each acoustic signal processing unit. Moreover, among the acoustic signals outputted from the respective acoustic signal processing units, the acoustic signals for the left speaker are added and supplied to the left speaker, and the acoustic signals for the right speaker are added and supplied to the right speaker.

Figure 9:
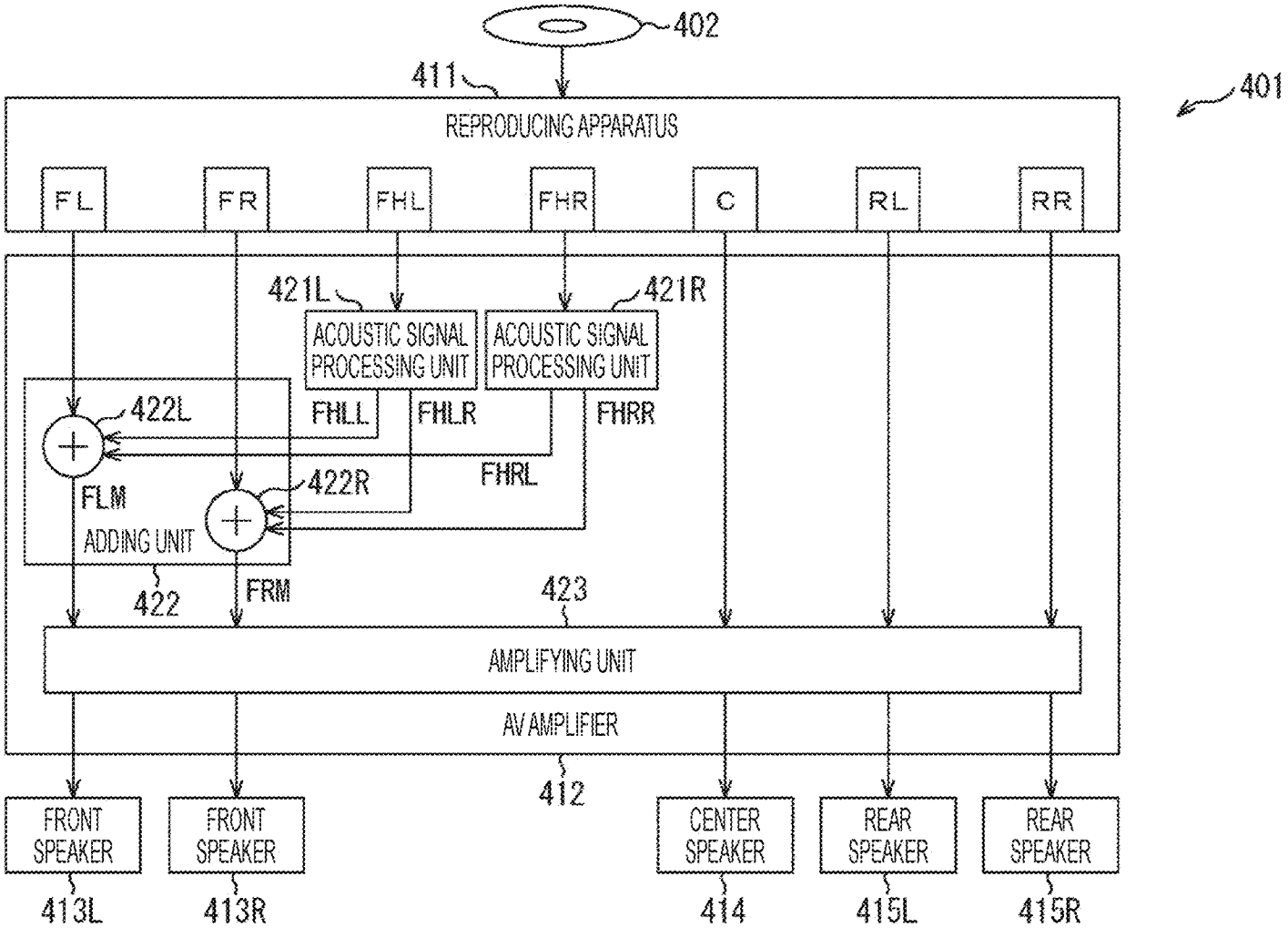
FIG. 9 is a diagram schematically showing a configuration example of the functions of an audio system to which the present technology is applied.

FIG. 9 is a block diagram schematically showing a configuration example of the functions of an audio system 401 that can virtually output sounds from virtual speakers at two places obliquely upward to the front left and obliquely upward to the front right of a predetermined listening position by using right and left front speakers.

The audio system 401 is configured by including a reproducing apparatus 411, an audio/visual (AV) amplifier 412, front speakers 413L and 413R, a center speaker 414 and rear speakers 415L and 415R.

The reproducing apparatus 411 is a reproducing apparatus capable of reproducing at least six channels of acoustic signals on the front left, the front right, the front center, the rear left, the rear right, the upper front left and the upper front right. For example, the reproducing apparatus 411 outputs an acoustic signal FL for the front left, an acoustic signal FR for the front right, an acoustic signal C for the front center, an acoustic signal RL for the rear left, an acoustic signal RR for the rear right, an acoustic signal FHL for the obliquely upward front left and an acoustic signal FHR for the obliquely upward front right, which are obtained by reproducing the six channels of the acoustic signals recorded on a recoding medium 402.

The AV amplifier 412 is configured by including acoustic signal processing units 421L and 421R, an adding unit 422 and an amplifying unit 423. Furthermore, the adding unit 422 is configured by including adding units 422L and 422R.

The acoustic signal processing unit 421L includes the acoustic signal processing unit 111L in FIG. 3 or the acoustic signal processing unit 311L in FIG. 6. The acoustic signal processing unit 421L is for an obliquely upward front left virtual speaker, and a sound source side HRTF and a sound source opposite side HRTF for the virtual speaker are applied.

Then, the acoustic signal processing unit 421L performs the acoustic signal processings previously described with reference to FIG. 4 or FIG. 7 on the acoustic signal FHL and generates acoustic signals FHLL and FHLR obtained as a result. Note that the acoustic signal FHLL corresponds to the acoustic signal SLout1 in FIGS. 3 and 6, and the acoustic signal FHLR corresponds to the acoustic signal SRout2 in FIGS. 3 and 6. The acoustic signal processing unit 421L supplies the acoustic signal FHLL to the adding unit 422L and supplies the acoustic signal FHLR to the adding unit 422R.

The acoustic signal processing unit 421R includes the acoustic signal processing unit 111R in FIG. 5 or the acoustic signal processing unit 311R in FIG. 8. The acoustic signal processing unit 421R is for an obliquely upward front right virtual speaker, and a sound source side HRTF and a sound source opposite side HRTF for the virtual speaker are applied.

Then, the acoustic signal processing unit 421R performs the acoustic signal processings previously described with reference to FIG. 4 or FIG. 7 on the acoustic signal FHR and generates acoustic signals FHRL and FHRR obtained as a result. Note that the acoustic signal FHRL corresponds to the acoustic signal SLout2 in FIGS. 5 and 8, and the acoustic signal FHRR corresponds to the acoustic signal SRout1 in FIGS. 5 and 8. The acoustic signal processing unit 421L supplies the acoustic signal FHRL to the adding unit 422L and supplies the acoustic signal FHRR to the adding unit 422R.

The adding unit 422L generates an acoustic signal FLM by adding the acoustic signal FL, the acoustic signal FHLL and the acoustic signal FHRL and supplies the acoustic signal FLM to the amplifying unit 423.

The adding unit 422R generates an acoustic signal FRM by adding the acoustic signal FR, the acoustic signal FHLR and the acoustic signal FHRR and supplies the acoustic signal FRM to the amplifying unit 423.

The amplifying unit 423 amplifies the acoustic signal FLM to the acoustic signal RR and supplies the acoustic signals FLM to the acoustic signal RR to the front speaker 413L to the rear speaker 415R, respectively.

The front speaker 413L and the front speaker 413R are arranged, for example, left-right symmetrically at the front of the predetermined listening position. Then, the front speaker 413L outputs a sound based on the acoustic signal FLM, and the front speaker 413R outputs a sound based on the acoustic signal FRM. Accordingly, the listener at the listening position senses not only the sounds outputted from the front speakers 413L and 413R but also the sounds as if the sounds are outputted from the virtual speakers arranged at two places obliquely upward to the front left and obliquely upward to the front right.

The center speaker 414 is arranged, for example, at the front center of the listening position. Then, the center speaker 414 outputs a sound based on the acoustic signal C.

The rear speaker 415L and the rear speaker 415R are arranged, for example, left-right symmetrically at the rear of the listening position. Then, the rear speaker 415L outputs a sound based on the acoustic signal RL, and the rear speaker 415R outputs a sound based on the acoustic signal RR.

Note that it is also possible to generate virtual speakers at two or more places on the same side (left side or right side) with reference to the median plane of the listener. For example, in a case where virtual speakers is generated at two or more places on the left side with reference to the median plane of the listener, the acoustic signal processing unit 111L or the acoustic signal processing unit 311L may be provided in parallel for each virtual speaker. In this case, the acoustic signals SLout1 outputted from the respective acoustic signal processing units are added and supplied to the left speaker, and the acoustic signals SRout2 outputted from the respective acoustic signal processing units are added and supplied to the right speaker. Moreover, in this case, it is possible to share an auxiliary signal synthesizing unit 122L.

Similarly, for example, in a case where virtual speakers is generated at two or more places on the right side with reference to the median plane of the listener, the acoustic signal processing unit 111R or the acoustic signal processing unit 311R may be provided in parallel for each virtual speaker. In this case, the acoustic signals SLout2 outputted from the respective acoustic signal processing units are added and supplied to the left speaker, and the acoustic signals SRout1 outputted from the respective acoustic signal processing units are added and supplied to the right speaker. Moreover, in this case, it is possible to share an auxiliary signal synthesizing unit 122R.

Furthermore, in a case where the acoustic signal processing unit 111L or the acoustic signal processing unit 111R is provided in parallel, it is possible to share a crosstalk correction processing unit 132.

5. Modification Examples

Hereinafter, modification examples of the above-described embodiments of the present technology will be described.

Modification Example 1: Modification Example of Configuration of Acoustic Signal Processing Unit For example, an auxiliary signal synthesizing unit 501L in FIG. 10 may be used instead of the auxiliary signal synthesizing unit 122L in FIGS. 3 and 6. Note that, in the drawing, parts corresponding to those in FIG. 3 are denoted by the same reference signs, and parts with the same processings are omitted as appropriate to omit the redundant explanations.

The auxiliary signal synthesizing unit 501L is different from the auxiliary signal synthesizing unit 122L in FIG. 3 in that delaying units 511L and 511R are added.

The delaying unit 511L delays the acoustic signal SLout1 supplied from the crosstalk correction processing unit 132 in FIG. 3 or the transaural integration processing unit 331 in FIG. 6 by a predetermined time and then supplies the acoustic signal SLout1 to the speaker 112L.

The delaying unit 511R delays the acoustic signal SRout1 supplied from the crosstalk correction processing unit 132 in FIG. 3 or the transaural integration processing unit 331 in FIG. 6 by a time same as that of the delaying unit 511L before the auxiliary signal SLsub is added, and supplies the acoustic signal SRout1 to the adding unit 162R.

In a case where the delaying units 511L and 511R are not provided, a sound based on the acoustic signal SLout1 (hereinafter, referred to as a main left sound), a sound based on the acoustic signal SRout1 (hereinafter, referred to as a main right sound), and a sound based on the auxiliary signal SLsub (hereinafter, referred to as an auxiliary sound) are outputted from the speakers 112L and 112R almost at the same time. Then, to the left ear EL of the listener P, the main left sound reaches first, and then the main right sound and the auxiliary sound reach almost at the same time. Also, to the right ear ER of the listener P, the main right sound and the auxiliary sound first reach almost at the same time first, and then the main left sound reach.

On the other hand, the delaying units 511L and 511R adjust the auxiliary sound so that the auxiliary sound reaches the left ear EL of the listener P ahead of the main left sound by a predetermined time (e.g., several milliseconds). It has been confirmed experimentally that this improves the localization sensation of the virtual speaker 113. It is considered that this is because the first notch and the second notch of the head-related transfer function G1, which appear in the main left sound, are more securely masked by the auxiliary sound at the left ear EL of the listener P due to forward masking of so-called temporal masking.

Figure 10:
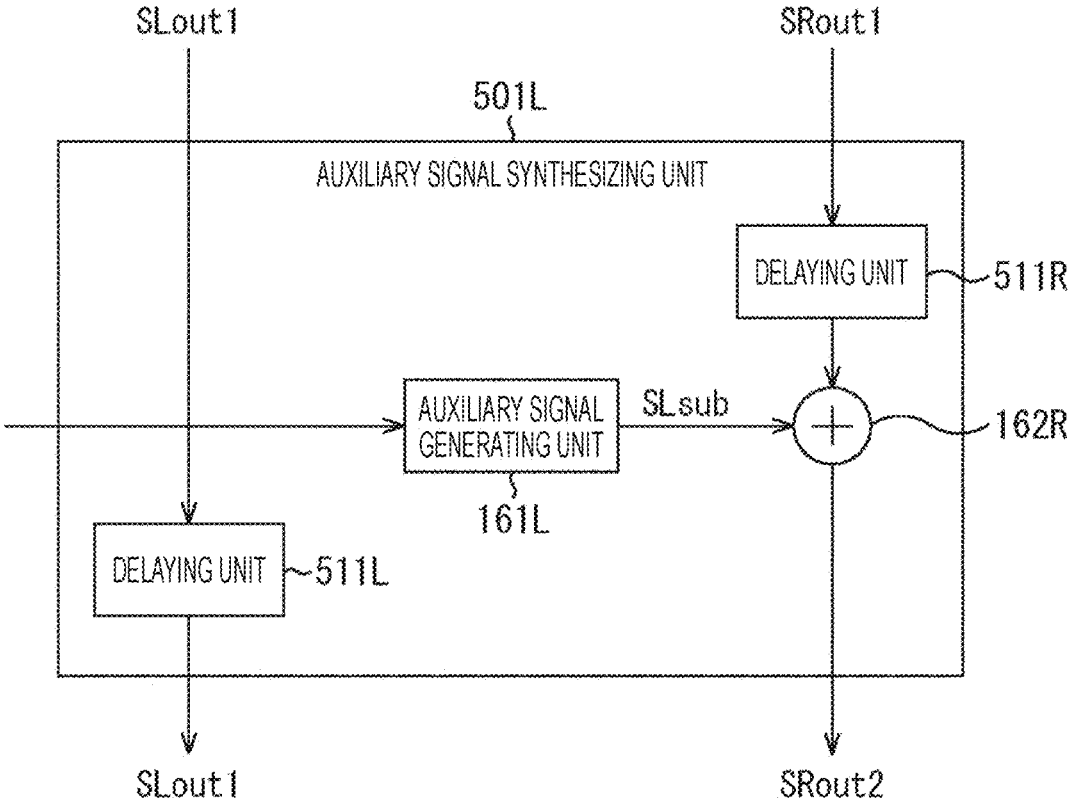
FIG. 10 is a diagram showing a modification example of an auxiliary signal synthesizing unit.

Note that, although not shown, a delaying unit can be provided for the auxiliary signal synthesizing unit 122R in FIG. 5 or FIG. 8 as the auxiliary signal synthesizing unit 501L in FIG. 10. In other words, it is possible to provide a delaying unit before the adding unit 162L and to provide a delaying unit between the adding unit 153R and the speaker 112R.

Modification Example 2: Modification Example of Position of Virtual Speaker

The present technology is effective in all cases where the virtual speaker is arranged at a position deviated to the right and left from the median plane of the listening position. For example, the present technology is also effective in a case where the virtual speaker is arranged obliquely upward to the rear left or obliquely upward to the rear right of the listening position. Moreover, for example, the present technology is also effective in a case where the virtual speaker is arranged obliquely downward to the front left or obliquely downward to the front right of the listening position or obliquely downward to the rear left or obliquely downward to the rear right of the listening position. Furthermore, for example, the present technology is also effective in a case where the virtual speaker is arranged left or right.

Modification Example 3: Modification Example of Arrangement of Speaker Used for Generating Virtual Speaker Moreover, in the above description, the case where the virtual speaker is generated by using the speakers arranged left-right symmetrically at the front of the listening position has been described in order to simplify the explanation. However, in the present technology, it is not always necessary to arrange the speakers left-right symmetrically at the front of the listening position. For example, the speakers can be arranged left-right asymmetrically at the front of the listening position. Furthermore, in the present technology, it is not always necessary to arrange the speaker at front of the listening position, and it is also possible to arrange the speaker at a place other than the front of the listening position (e.g., the rear of the listening position). Note that it is necessary to change the functions used for the crosstalk correction processing as appropriate depending on the place where the speaker is arranged.

Note that the present technology can be applied to, for example, various devices and systems for realizing the virtual surround system, such as the above-described AV amplifier.

{Configuration Example of Computer}

The series of processings described above can be executed by hardware or can be executed by software. In a case where the series of processings is executed by the software, a program constituting that software is installed in a computer. Here, the computer includes a computer incorporated into dedicated hardware and, for example, a general-purpose personal computer capable of executing various functions by being installed with various programs.

Figure 11:
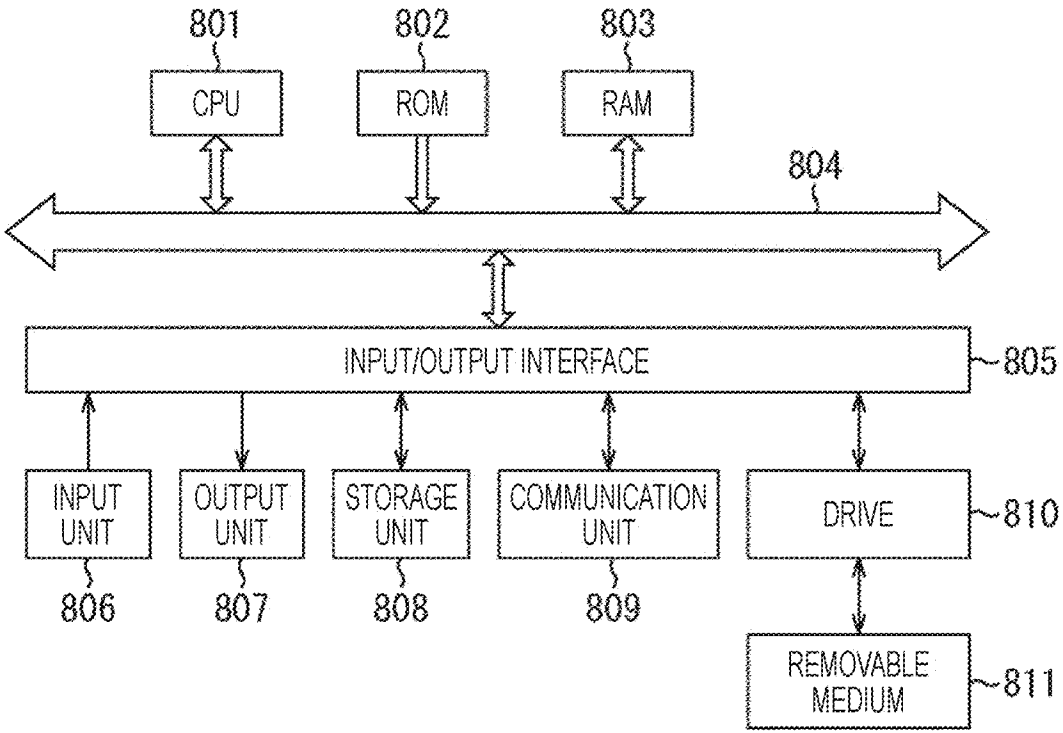
FIG. 11 is a block diagram showing a configuration example of a computer.

FIG. 11 is a block diagram showing a configuration example of hardware of a computer which executes the above-described series of processings by a program.

In a computer, a central processing unit (CPU) 801, a read only memory (ROM) 802 and a random access memory (RAM) 803 are connected to each other by a bus 804.

The bus 804 is further connected to an input/output interface 805. To the input/output interface 805, an input unit 806, an output unit 807, a storage unit 808, a communication unit 809 and a drive 810 are connected.

The input unit 806 includes a keyboard, a mouse, a microphone and the like. The output unit 807 includes a display, a speaker and the like. The storage unit 808 includes a hard disk, a nonvolatile memory and the like. The communication unit 809 includes a network interface and the like. The drive 810 drives a removable medium 811 such as a magnetic disk, an optical disk, a magneto-optical disk, or a semiconductor memory.

In the computer configured as described above, the CPU 801 loads, for example, a program stored in the storage unit 808 into the RAM 803 via the input/output interface 805 and the bus 804 and executes the program, thereby performing the above-described series of processings.

The program executed by the computer (CPU 801) can be, for example, recorded on the removable medium 811 as a package medium or the like to be provided. Moreover, the program can be provided via a wired or wireless transmission medium such as a local area network, the Internet, or digital satellite broadcasting.

In the computer, the program can be installed in the storage unit 808 via the input/output interface 805 by attaching the removable medium 811 to the drive 810. Furthermore, the program can be received by the communication unit 809 via the wired or wireless transmission medium and installed in the storage unit 808. In addition, the program can be installed in the ROM 802 or the storage unit 808 in advance.

Note that the program executed by the computer may be a program in which the processings are performed in time series according to the order described in the specification, or may be a program in which the processings are performed in parallel or at necessary timings such as when a call is made.

Further, in the specification, the system means a group of a plurality of constituent elements (apparatuses, modules (parts) and the like), and it does not matter whether or not all the constituent elements are in the same housing. Therefore, a plurality of apparatuses, which are housed in separate housings and connected via a network, and one apparatus, in which a plurality of modules are housed in one housing, are both systems.

Moreover, the embodiments of the present technology are not limited to the above embodiments, and various modifications can be made in a scope without departing from the gist of the present technology.

For example, the present technology can adopt the configuration of cloud computing in which one function is shared and collaboratively processed by a plurality of apparatuses via a network.

Furthermore, each step described in the above-described flowcharts can be executed by one apparatus or can also be shared and executed by a plurality of apparatuses.

Further, in a case where a plurality of processings are included in one step, the plurality of processings included in the one step can be executed by one apparatus or can also be shared and executed by a plurality of apparatuses.

In addition, the effects described in the specification are merely examples and are not limited, and other effects may be exerted.

Moreover, for example, the present technology can also adopt the following configurations.

(1)

An acoustic signal processing apparatus including:

a first transaural processing unit that generates a first binaural signal for a first input signal, which is an acoustic signal for a first virtual sound source deviated to left or right from a median plane of a predetermined listening position, by using a first head-related transfer function between an ear of a listener at the listening position farther from the first virtual sound source and the first virtual sound source, generates a second binaural signal for the first input signal by using a second head-related transfer function between an ear of the listener closer to the first virtual sound source and the first virtual sound source, and generates a first acoustic signal and a second acoustic signal by performing crosstalk correction processing on the first binaural signal and the second binaural signal as well as attenuates a component of a first frequency band and a component of a second frequency band in the first input signal or the second binaural signal to attenuate the component of the first frequency band and the component of the second frequency band of the first acoustic signal and the second acoustic signal, the first frequency band being lowest and the second frequency band being second lowest at a predetermined first frequency or more of frequency bands in which notches, which are negative peaks with amplitude of a predetermined depth or deeper, appear in the first head-related transfer function; and a first auxiliary signal synthesizing unit that generates a third acoustic signal by adding a first auxiliary signal to the first acoustic signal, the first auxiliary signal including a component of a predetermined third frequency band of the first input signal, in which the component of the first frequency band and the component of the second frequency band are attenuated, or the component of the third frequency band of the second binaural signal, in which the component of the first frequency band and the component of the second frequency band are attenuated.

(2)

The acoustic signal processing apparatus according to (1), in which the first transaural processing unit includes:

an attenuating unit that generates an attenuation signal obtained by attenuating the component of the first frequency band and the component of the second frequency band of the first input signal; and a signal processing unit that integrally performs processing for generating the first binaural signal obtained by superimposing the first head-related transfer function on the attenuation signal and the second binaural signal obtained by superimposing the second head-related transfer function on the attenuation signal and the crosstalk correction processing on the first binaural signal and the second binaural signal, and the first auxiliary signal includes the component of the third frequency band of the attenuation signal.

(3)

The acoustic signal processing apparatus according to (1), in which the first transaural processing unit includes:

a first binauralization processing unit that generates the first binaural signal obtained by superimposing the first head-related transfer function on the first input signal;

a second binauralization processing unit that generates the second binaural signal obtained by superimposing the second head-related transfer function on the first input signal as well as attenuates the component of the first frequency band and the component of the second frequency band of the first input signal before the second head-related transfer function is superimposed or of the second binaural signal after the second head-related transfer function is superimposed; and a crosstalk correction processing unit that performs the crosstalk correction processing on the first binaural signal and the second binaural signal.

(4)

The acoustic signal processing apparatus according to (3), in which the first binauralization processing unit attenuates the component of the first frequency band and the component of the second frequency band of the first input signal before the first head-related transfer function is superimposed or of the first binaural signal after the first head-related transfer function is superimposed.

(5)

The acoustic signal processing apparatus according to any one of (1) to (4), in which the third frequency band includes at least a lowest frequency band and a second lowest frequency band at a predetermined second frequency or more of frequency bands in which the notches appear in a third head-related transfer function between one speaker of two speakers arranged left and right with respect to the listening position and one ear of the listener, a lowest frequency band and a second lowest frequency band at a predetermined third frequency or more of frequency bands in which the notches appear in a fourth head-related transfer function between an other speaker of the two speakers and an other ear of the listener, a lowest frequency band and a second lowest frequency band at a predetermined fourth frequency or more of frequency bands in which the notches appear in a fifth head-related transfer function between the one speaker and the other ear, or a lowest frequency band and a second lowest frequency band at a predetermined fifth frequency or more of frequency bands in which the notches appear in a sixth head-related transfer function between the other speaker and the one ear.

(6)

The acoustic signal processing apparatus according to any one of (1) to (5), further including:

a first delaying unit that delays the first acoustic signal by a predetermined time before the first auxiliary signal is added; and a second delaying unit that delays the second acoustic signal by the predetermined time.

(7)

The acoustic signal processing apparatus according to any one of (1) to (6), in which the first auxiliary signal synthesizing unit adjusts a level of the first auxiliary signal before the first auxiliary signal is added to the first acoustic signal.

(8)

The acoustic signal processing apparatus according to any one of (1) to (7), further including:

a second transaural processing unit that generates a third binaural signal for a second input signal, which is an acoustic signal for a second virtual sound source deviated to left or right from the median plane, by using a seventh head-related transfer function between an ear of the listener farther from the second virtual sound source and the second virtual sound source, generates a fourth binaural signal for the second input signal by using an eighth head-related transfer function between an ear of the listener closer to the second virtual sound source and the second virtual sound source, and generates a fourth acoustic signal and a fifth acoustic signal by performing the crosstalk correction processing on the third binaural signal and the fourth binaural signal as well as attenuates a component of a fourth frequency band and a component of a fifth frequency band in the second input signal or the fourth binaural signal to attenuate the component of the fourth frequency band and the component of the fifth frequency band of the fifth acoustic signal, the fourth frequency band being lowest and the fifth frequency band being second lowest at a predetermined sixth frequency or more of frequency bands, in which the notches appear in the seventh head-related transfer function;

a second auxiliary signal synthesizing unit that generates a sixth acoustic signal by adding a second auxiliary signal to the fourth acoustic signal, the second auxiliary signal including the component of the third frequency band of the second input signal, in which the component of the fourth frequency band and the component of the fifth frequency band are attenuated, or the component of the third frequency band of the fourth binaural signal, in which the component of the fourth frequency band and the component of the fifth frequency band are attenuated; and an adding unit that adds the third acoustic signal and the fifth acoustic signal and adds the second acoustic signal and the sixth acoustic signal in a case where the first virtual sound source and the second virtual sound source are separated to left and right with reference to the median plane, and adds the third acoustic signal and the sixth acoustic signal and adds the second acoustic signal and the fifth acoustic signal in a case where the first virtual sound source and the second virtual sound source are on a same side with reference to the median plane.

(9)

The acoustic signal processing apparatus according to any one of (1) to (8), in which the first frequency is a frequency at which a positive peak appears in a vicinity of 4 kHz of the first head-related transfer function.

(10)

The acoustic signal processing apparatus according to any one of (1) to (9), in which the crosstalk correction processing is processing that cancels, for the first binaural signal and the second binaural signal, an acoustic transfer characteristic between a speaker of the two speakers arranged left and right with respect to the listening position on an opposite side of the first virtual sound source with reference to the median plane and the ear of the listener farther from the first virtual sound source, an acoustic transfer characteristic between a speaker of the two speakers on a side of the virtual sound source with reference to the median plane and the ear of the listener closer to the first virtual sound source, crosstalk from the speaker on the opposite side of the first virtual sound source to the ear of the listener closer to the first virtual sound source, and crosstalk from the speaker on the side of the virtual sound source to the ear of the listener farther from the first virtual sound source.

(11)

An acoustic signal processing method including:

a transaural processing step that generates a first binaural signal for an input signal, which is an acoustic signal for a virtual sound source deviated to left or right from a median plane of a predetermined listening position, by using a first head-related transfer function between an ear of a listener at the listening position farther from the virtual sound source and the virtual sound source, generates a second binaural signal for the input signal by using a second head-related transfer function between an ear of the listener closer to the virtual sound source and the virtual sound source, and generates a first acoustic signal and a second acoustic signal by performing crosstalk correction processing on the first binaural signal and the second binaural signal as well as attenuates a component of a first frequency band and a component of a second frequency band in the input signal or the second binaural signal to attenuate the component of the first frequency band and the component of the second frequency band of the first acoustic signal and the second acoustic signal, the first frequency band being lowest and the second frequency band being second lowest at a predetermined frequency or more of frequency bands in which notches, which are negative peaks with amplitude of a predetermined depth or deeper, appear in the first head-related transfer function; and an auxiliary signal synthesizing step that generates a third acoustic signal by adding an auxiliary signal to the first acoustic signal, the auxiliary signal including a component of a predetermined third frequency band of the input signal, in which the component of the first frequency band and the component of the second frequency band are attenuated, or the component of the third frequency band of the second binaural signal, in which the component of the first frequency band and the component of the second frequency band are attenuated.

(12)

A program for causing a computer to execute processing including:

a transaural processing step that generates a first binaural signal for an input signal, which is an acoustic signal for a virtual sound source deviated to left or right from a median plane of a predetermined listening position, by using a first head-related transfer function between an ear of a listener at the listening position farther from the virtual sound source and the virtual sound source, generates a second binaural signal for the input signal by using a second head-related transfer function between an ear of the listener closer to the virtual sound source and the virtual sound source, and generates a first acoustic signal and a second acoustic signal by performing crosstalk correction processing on the first binaural signal and the second binaural signal as well as attenuates a component of a first frequency band and a component of a second frequency band in the input signal or the second binaural signal to attenuate the component of the first frequency band and the component of the second frequency band of the first acoustic signal and the second acoustic signal, the first frequency band being lowest and the second frequency band being second lowest at a predetermined frequency or more of frequency bands in which notches, which are negative peaks with amplitude of a predetermined depth or deeper, appear in the first head-related transfer function; and an auxiliary signal synthesizing step that generates a third acoustic signal by adding an auxiliary signal to the first acoustic signal, the auxiliary signal including a component of a predetermined third frequency band of the input signal, in which the component of the first frequency band and the component of the second frequency band are attenuated, or the component of the third frequency band of the second binaural signal, in which the component of the first frequency band and the component of the second frequency band are attenuated.

REFERENCE SIGNS LIST

101L, 101R Acoustic signal processing system
111L, 111R Acoustic signal processing unit
112L, 112R Speaker
113 Virtual speaker
121L, 121R Transaural processing unit
122L, 122R Auxiliary signal synthesizing unit
131L, 131R Binauralization processing unit
132 Crosstalk correction processing unit
141, 141L, 141R Notch forming equalizer
142L, 142R Binaural signal generating unit
151L to 152R Signal processing unit
153L, 153R Adding unit
161L, 161R Auxiliary signal generating unit
162L, 162R Adding unit
181, 181L, 181R Notch forming equalizer
301L, 301R Acoustic signal processing system
311L, 311R Acoustic signal processing unit
321L, 321R Transaural processing unit
331 Transaural integration processing unit
351L, 351R Signal processing unit
401 Audio system
412 AV Amplifier
421L, 421R Acoustic signal processing unit
422L, 422R Adding unit
501L Auxiliary signal synthesizing unit
511L, 511R Delaying unit
EL Left ear
ER Right ear
G1, G2, HL, HR Head-related transfer function
P Listener

The invention claimed is:

1. An acoustic signal processing apparatus comprising:

a first transaural processing unit that generates a first binaural signal for a first input signal, which is an acoustic signal for a first virtual sound source deviated to left or right from a median plane of a predetermined listening position, by using a first head-related transfer function between an ear of a listener at the listening position farther from the first virtual sound source and the first virtual sound source, generates a second binaural signal for the first input signal by using a second head-related transfer function between an ear of the listener closer to the first virtual sound source and the first virtual sound source, and generates a first acoustic signal and a second acoustic signal by performing crosstalk correction processing on the first binaural signal and the second binaural signal as well as attenuates a component of a first frequency band and a component of a second frequency band in the first input signal or the second binaural signal to attenuate the component of the first frequency band and the component of the second frequency band of the first acoustic signal and the second acoustic signal, the first frequency band being lowest and the second frequency band being second lowest at a predetermined first frequency or more of frequency bands in which notches, which are negative peaks with amplitude of a predetermined depth or deeper, appear in the first head-related transfer function; and a first auxiliary signal synthesizing unit that generates a third acoustic signal by adding a first auxiliary signal to the first acoustic signal, the first auxiliary signal including a component of a predetermined third frequency band of the first input signal, in which the component of the first frequency band and the component of the second frequency band are attenuated, or the component of the third frequency band of the second binaural signal, in which the component of the first frequency band and the component of the second frequency band are attenuated.

2. The acoustic signal processing apparatus according to claim 1, wherein the first transaural processing unit comprises:

an attenuating unit that generates an attenuation signal obtained by attenuating the component of the first frequency band and the component of the second frequency band of the first input signal; and a signal processing unit that integrally performs processing for generating the first binaural signal obtained by superimposing the first head-related transfer function on the attenuation signal and the second binaural signal obtained by superimposing the second head-related transfer function on the attenuation signal and the crosstalk correction processing on the first binaural signal and the second binaural signal, and the first auxiliary signal includes the component of the third frequency band of the attenuation signal.

3. The acoustic signal processing apparatus according to claim 1, wherein the first transaural processing unit comprises:

a first binauralization processing unit that generates the first binaural signal obtained by superimposing the first head-related transfer function on the first input signal;

a second binauralization processing unit that generates the second binaural signal obtained by superimposing the second head-related transfer function on the first input signal as well as attenuates the component of the first frequency band and the component of the second frequency band of the first input signal before the second head-related transfer function is superimposed or of the second binaural signal after the second head-related transfer function is superimposed; and a crosstalk correction processing unit that performs the crosstalk correction processing on the first binaural signal and the second binaural signal.

4. The acoustic signal processing apparatus according to claim 3, wherein the first binauralization processing unit attenuates the component of the first frequency band and the component of the second frequency band of the first input signal before the first head-related transfer function is superimposed or of the first binaural signal after the first head-related transfer function is superimposed.

5. The acoustic signal processing apparatus according to claim 1, wherein the third frequency band includes at least a lowest frequency band and a second lowest frequency band at a predetermined second frequency or more of frequency bands in which the notches appear in a third head-related transfer function between one speaker of two speakers arranged left and right with respect to the listening position and one ear of the listener, a lowest frequency band and a second lowest frequency band at a predetermined third frequency or more of frequency bands in which the notches appear in a fourth head-related transfer function between an other speaker of the two speakers and an other ear of the listener, a lowest frequency band and a second lowest frequency band at a predetermined fourth frequency or more of frequency bands in which the notches appear in a fifth head-related transfer function between the one speaker and the other ear, or a lowest frequency band and a second lowest frequency band at a predetermined fifth frequency or more of frequency bands in which the notches appear in a sixth head-related transfer function between the other speaker and the one ear.

6. The acoustic signal processing apparatus according to claim 1, further comprising:

a first delaying unit that delays the first acoustic signal by a predetermined time before the first auxiliary signal is added; and a second delaying unit that delays the second acoustic signal by the predetermined time.

7. The acoustic signal processing apparatus according to claim 1, wherein the first auxiliary signal synthesizing unit adjusts a level of the first auxiliary signal before the first auxiliary signal is added to the first acoustic signal.

8. The acoustic signal processing apparatus according to claim 1, further comprising:

a second transaural processing unit that generates a third binaural signal for a second input signal, which is an acoustic signal for a second virtual sound source deviated to left or right from the median plane, by using a seventh head-related transfer function between an ear of the listener farther from the second virtual sound source and the second virtual sound source, generates a fourth binaural signal for the second input signal by using an eighth head-related transfer function between an ear of the listener closer to the second virtual sound source and the second virtual sound source, and generates a fourth acoustic signal and a fifth acoustic signal by performing the crosstalk correction processing on the third binaural signal and the fourth binaural signal as well as attenuates a component of a fourth frequency band and a component of a fifth frequency band in the second input signal or the fourth binaural signal to attenuate the component of the fourth frequency band and the component of the fifth frequency band of the fifth acoustic signal, the fourth frequency band being lowest and the fifth frequency band being second lowest at a predetermined sixth frequency or more of frequency bands, in which the notches appear in the seventh head-related transfer function;

a second auxiliary signal synthesizing unit that generates a sixth acoustic signal by adding a second auxiliary signal to the fourth acoustic signal, the second auxiliary signal including the component of the third frequency band of the second input signal, in which the component of the fourth frequency band and the component of the fifth frequency band are attenuated, or the component of the third frequency band of the fourth binaural signal, in which the component of the fourth frequency band and the component of the fifth frequency band are attenuated; and an adding unit that adds the third acoustic signal and the fifth acoustic signal and adds the second acoustic signal and the sixth acoustic signal in a case where the first virtual sound source and the second virtual sound source are separated to left and right with reference to the median plane, and adds the third acoustic signal and the sixth acoustic signal and adds the second acoustic signal and the fifth acoustic signal in a case where the first virtual sound source and the second virtual sound source are on a same side with reference to the median plane.

9. The acoustic signal processing apparatus according to claim 1, wherein the first frequency is a frequency at which a positive peak appears in a vicinity of 4 kHz of the first head-related transfer function.

10. The acoustic signal processing apparatus according to claim 1, wherein the crosstalk correction processing is processing that cancels, for the first binaural signal and the second binaural signal, an acoustic transfer characteristic between a speaker of two speakers arranged left and right with respect to the listening position on an opposite side of the first virtual sound source with reference to the median plane and the ear of the listener farther from the first virtual sound source, an acoustic transfer characteristic between a speaker of the two speakers on a side of the virtual sound source with reference to the median plane and the ear of the listener closer to the first virtual sound source, crosstalk from the speaker on the opposite side of the first virtual sound source to the ear of the listener closer to the first virtual sound source, and crosstalk from the speaker on the side of the virtual sound source to the ear of the listener farther from the first virtual sound source.

11. An acoustic signal processing method comprising:

a transaural processing step that generates a first binaural signal for an input signal, which is an acoustic signal for a virtual sound source deviated to left or right from a median plane of a predetermined listening position, by using a first head-related transfer function between an ear of a listener at the listening position farther from the virtual sound source and the virtual sound source, generates a second binaural signal for the input signal by using a second head-related transfer function between an ear of the listener closer to the virtual sound source and the virtual sound source, and generates a first acoustic signal and a second acoustic signal by performing crosstalk correction processing on the first binaural signal and the second binaural signal as well as attenuates a component of a first frequency band and a component of a second frequency band in the input signal or the second binaural signal to attenuate the component of the first frequency band and the component of the second frequency band of the first acoustic signal and the second acoustic signal, the first frequency band being lowest and the second frequency band being second lowest at a predetermined frequency or more of frequency bands in which notches, which are negative peaks with amplitude of a predetermined depth or deeper, appear in the first head-related transfer function; and an auxiliary signal synthesizing step that generates a third acoustic signal by adding an auxiliary signal to the first acoustic signal, the auxiliary signal including a component of a predetermined third frequency band of the input signal, in which the component of the first frequency band and the component of the second frequency band are attenuated, or the component of the third frequency band of the second binaural signal, in which the component of the first frequency band and the component of the second frequency band are attenuated.

12. A program for causing a computer to execute processing including:

a transaural processing step that generates a first binaural signal for an input signal, which is an acoustic signal for a virtual sound source deviated to left or right from a median plane of a predetermined listening position, by using a first head-related transfer function between an ear of a listener at the listening position farther from the virtual sound source and the virtual sound source, generates a second binaural signal for the input signal by using a second head-related transfer function between an ear of the listener closer to the virtual sound source and the virtual sound source, and generates a first acoustic signal and a second acoustic signal by performing crosstalk correction processing on the first binaural signal and the second binaural signal as well as attenuates a component of a first frequency band and a component of a second frequency band in the input signal or the second binaural signal to attenuate the component of the first frequency band and the component of the second frequency band of the first acoustic signal and the second acoustic signal, the first frequency band being lowest and the second frequency band being second lowest at a predetermined frequency or more of frequency bands in which notches, which are negative peaks with amplitude of a predetermined depth or deeper, appear in the first head-related transfer function; and an auxiliary signal synthesizing step that generates a third acoustic signal by adding an auxiliary signal to the first acoustic signal, the auxiliary signal including a component of a predetermined third frequency band of the input signal, in which the component of the first frequency band and the component of the second frequency band are attenuated, or the component of the third frequency band of the second binaural signal, in which the component of the first frequency band and the component of the second frequency band are attenuated.

* * * * *